US006499903B1

(12) United States Patent
Schwartz

(10) Patent No.: US 6,499,903 B1
(45) Date of Patent: Dec. 31, 2002

(54) MORPHING LEAF

(75) Inventor: David C. Schwartz, Southboro, MA (US)

(73) Assignee: Productive Environments Inc., Fromizham, MA (US)

( * ) Notice: Subject to any disclaimer, the term of this patent is extended or adjusted under 35 U.S.C. 154(b) by 0 days.

(21) Appl. No.: 09/627,947

(22) Filed: Jul. 28, 2000

Related U.S. Application Data

(60) Provisional application No. 60/146,277, filed on Jul. 29, 1999.

(51) Int. Cl.[7] ..... B42F 13/00

(52) U.S. Cl. ..... 402/79; 281/38; 402/80 R; 462/66

(58) Field of Search ..... 281/15.1, 38; 402/79, 402/80 R; 462/66; D19/26, 33

(56) References Cited

U.S. PATENT DOCUMENTS 5,048,869 A 9/1991 Schwartz ..... 281/16
5,165,721 A 11/1992 Schwartz ..... 281/15.1
5,209,592 A * 5/1993 Bedol ..... 402/1
5,219,239 A * 6/1993 Bianco ..... 281/51
5,316,341 A 5/1994 Schwartz ..... 281/15.1
5,380,043 A 1/1995 Schwartz ..... 281/16
5,405,169 A 4/1995 Schwartz ..... 281/16
5,407,231 A 4/1995 Schwartz ..... 281/16
5,524,998 A * 6/1996 Schwartz ..... 402/79
5,597,256 A * 1/1997 Burton et al. ..... 402/4
5,915,873 A * 6/1999 Karlis ..... 402/79
6,183,157 B1 * 2/2001 Brown et al. ..... 402/79

* cited by examiner

*Primary Examiner*—A. L. Wellington
*Assistant Examiner*—Monica Carter

(57) ABSTRACT

The invention relates to leaf accessory holders, and in particular to leaf accessory holders otherwise known as mechanical "windowing" devices which can be positioned into multiple locations while still attached to a host. The new elements of the invention are a morphable leaf, which leaf itself has joined functional portions for allowing the transformation of the leaf into a multi-position device, said morphing leaf formed as a planar multisided structure comprising both the mounting leaf and the orientation leaf portion, where both the mounting leaf and the orientation leaf can be positioned into a first position to lie flat, in the same plane, and further where the orientation leaf portion can be rotationally respositioned by 180 degrees into a second location substantially adjacent itself.

4 Claims, 19 Drawing Sheets

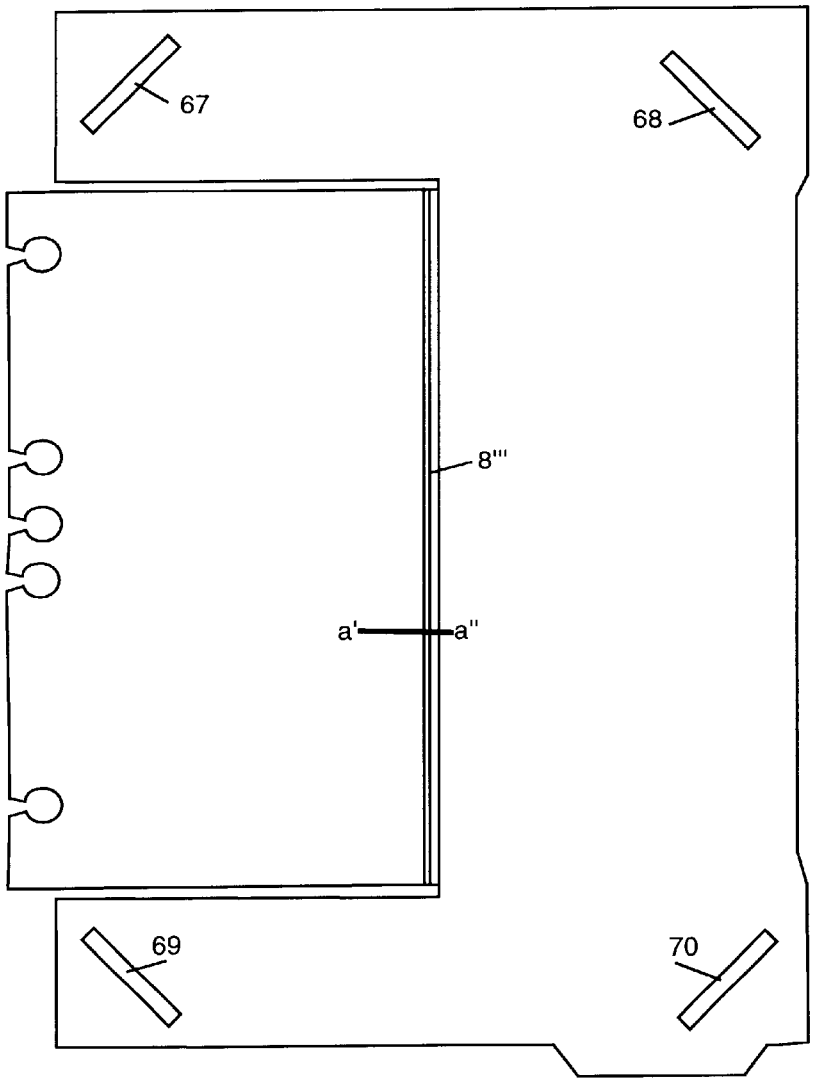
Fig. 5
Fig. 5a
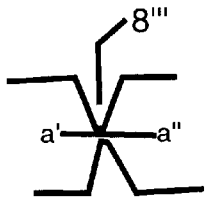
Fig.5b
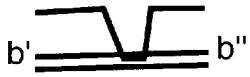
Fig. 5c
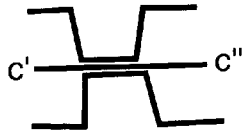

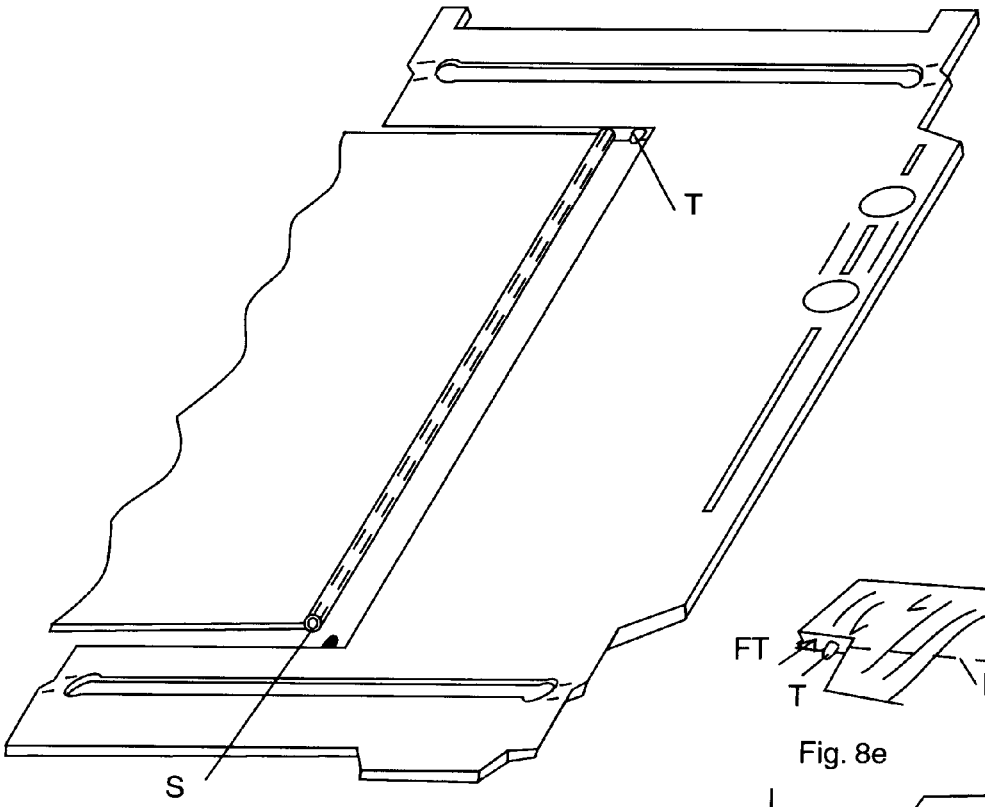
Fig.8d
Fig. 8e
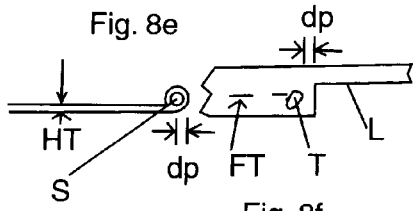
Fig. 8f

MORPHING LEAF

This application claims the benefit of provisional application No. 60/146,277, filed Jul. 29, 1999.

BACKGROUND OF THE INVENTION

The invention relates to leaf accessory holders, and in particular to leaf accessory holders otherwise known as mechanical "windowing" devices which can be positioned into multiple locations while still attached to a host. The new elements of the invention are a morphable leaf, which leaf itself has joined functional portions for allowing the transformation of the leaf into a multi-position device, said morphing leaf formed as a planar multi-sided structure comprising both the mounting leaf portion and the orientation leaf portion, where both the mounting leaf and the orientation leaf can be positioned into a first position to lie flat, in the same plane, and further where the orientation leaf portion can be rotationally repositioned by 180 degrees into a second location substantially adjacent itself.

This invention relates to the formation of windowing devices having mounting surfaces and orientation panels, as detailed for example, in "hypertext book attachment" U.S. Pat. No. 5,380,043 filed Mar 16, 1989, by patent holder, the one and same, David C. Schwartz. This prior art provides a working definition of windowing, to provide further clarification of the field of art for the object of invention of this application. Windowing devices are defined as devices that "can be folded into the (book on either side while retaining the same orientation of the mounting surface. This property, enabled by the orientation flap, permits retention of the orientation of the mounting surface in a plurality of positions, not only with respect to a host book but with respect to different positions of the mounting surface itself, and enables the property referred to earlier as windowing".

Further more, this invention relates specifically to windowing leaf structures, as in "windowing leaf structure" U.S. Pat. No. 5,407,231 filed Nov. 23, 1992, by patent holder, the one and same, David C. Schwartz, where, to provide further clarification as to the general nature of the behavior of such windowing leaf structures. Using this patent, one skilled in the art would know the quoted text copied herein, from portions of columns, 1, 3, 4, 5, and 6 that states "The invention therefore relates to mounting surfaces that are attached to a flap that preserves the orientation of the face surface of the mounting surface in a plurality of locations, with respect to the book to which it is attached. This invention relates to binding systems . . . (having) . . . leafs with mounting surfaces which may be directly attached to a host book, it's bindings, it's surfaces, and or its covers, which in and of themselves provide non-sequential(non-linear) access to their mounting surfaces without needing to be removed from their attachment to the host book, it's bindings and/or it's surfaces, and which offer further non-linear access when physically removed from their binding and repositioned. The invention relates to the provision of such on-linear pages which possess the property hereinafter referred to as "windowing", the ability for the page to maintain it's face and perimeter orientation in various positions without being removed from the host book to which they are attached, and to such pages implemented with means for semi-permanent attachment, there by offering 2 levels of non-linear access. The invention relates leaves with mounting surfaces offering semi-permanent retaining means which enable easy removal and reinsertion, and to book systems formed by combining covers, rings, and mounting surfaces according to this invention that offer highly visual means for handling information."

This invention relates to a windowing leaf attachment structure, implemented in such a manner as to be permanently attached to a binding, semi-permanently attached to a binding, and or permanently or semi-permanently attached to any surface, such as a cover, or other surfaces, such as other pages of a host book. The binding means for attaching the surface to the book may require the opening or closing of a ring mechanism for removal and repositioning."

This invention relates to windowing leaf structures having behaviors typically known to be in accordance with this class of windowing invention, where the prototypical embodiments known in the art provide at least two variations of surfaces implemented as windowing devices. "One retains its face and perimeter orientation in four positions about it's host coupling structure while remaining attached to it's host coupling structure. A second retains it's face and perimeter orientation in two co-planar and substantially adjacent locations about the host coupling structure, while staying attached to the host coupling structure. Either of these may be implemented with traditional holes that fix the flap to a binding. It is preferable to implement them with the insertable holes." The four position device has a mounting surface attached to an orientation flap which is in turn attached to an extension flap. The orientation flap is attached to the extension flap via a flexible material which adds heith(clearance height) when the mounting surface is positioned to encompas interleaved sheets which might also be attached to the host book binding. The flexible material is optional. "The two position device" has a mounting surface attached to an orientation flap along a line substantially parallel to and substantially mid-way between two parallel outer edges of the mounting surface. In this variation the orientation flap has a slotted hole pattern implemented along it's parallel edge opposing the edge bound to the mounting surface. This implementation allows for the co-planar location of the mounting surface in two positions about the binding, wherein the face and perimeter orientation of the mounting surface is preserved in both substantially adjacent locations."

It is known as a matter of prior art to one skilled in this subcategory of inventions, and by referring to at least the above two mentioned patents, that the prior art provides for a minimal set of components to construct both of the windowing devices "folded from one sheet of foldable material", where in the construction employs two mounting surfaces, a first "mounting surface is intended to receive a second mounting surface which would be placed. thereon and would carry some form of device such as a pad", thereby forming a windowing device which is automatically two layers thick with the third layer formed by the add on accessory itself, see the figure included following which depicts the multiple surfaces, before attaching the third layer device such as the pad. It is known that thickness is a detriment in making accessories for binders, so the purpose of the invention herein disclosed is to form such a windowing device from a minimal construction that removes one of the two layers identified above.

The publicly known solution which is most related to this invention has an integral mounting panel comprising a substantially retangular surface to which is attached by various means, an orientation panel. The orientation panel is pivotally attached at a location between the opposing ends of the the mounting panel, allowing the mounting panel to be positioned into multiple locations. The disadvantage of this structure is that the structure has double thinkness in all positions. It is also more expensive to form the publically known structures, since these structures require a folding and sealing operation, or require assembly of sections which lie in double thinkness when coincident, one with the other. The portion of material also adds an extra step in formation and makes these embodiments more expensive to manufacture.

SUMMARY OF THE INVENTION

The invention therefore relates to leaf accessory holders, and in particular to leaf accessory holders otherwise known as mechanical "windowing" devices which can be positioned into multiple locations while still attached to a host. The invention particularly relates to such leaf accessory holders where the leaf is formed itself as a multipart structure capable of providing both the mounting feature and the orientation feature in a multi-sided structure that lies in the same flat plane.

The invention further relates to a multi-section leaf which comprises a mounting leaf formed as a multi-sided portion and an orientation leaf formed as a hingedly adjoining multi-sided portion. The invention relates to the formation of this platform as an integral unit made as a stamping from a single section of pliable material. It also relates to the formation of this platform from separate pieces of material including a variety of materials and a variety of attachment structures. The invention also relates to the combination of this platform portion with other portions so as to form binders, pad holders, clip boards and the like. The invention further relates to the use of this platform as an accessory for removable attachment to a host. The invention relates to the use of this accessory platform as a permanent attachment to be separately attached to a host. The invention relates to the combination of this platform with any number of accessory cards which can be mounted into the device or which can be sold alongside the device for later assembly, inicuding postit note pads, sheets of padded papers, and cards with four corners that can be inserted into the mounting leaf portion, which cards themselves carry other accessories or are write erasable.

Further, the invention relates to an accessory which is constructed from a variety of materials. The platform may be formed in pliable plastic capable of providing a living hinge. Such plastics include polypropalene, polyethelene, and the like. In such case, the platform and its full combination can be formed from a single integral piece of material. Otherwise, the invention may be formed in aluminum with a piano hinge. It may also be molded plastic such as styrene or the like plastic with snap in mating pivotal hinge portions, or overlapping finger portions. When molded in such formable plastic or aluminum construction, or other such rigid formable material such as laminated veneer or the like, the orientation leaf portion may be formed by a frame, or the attachment edge of the orientation leaf may be pivotally connected to a host on a frame.

In particular the invention relates to a multi-sided morphable leaf platform comprising a mounting leaf portion and an orientation leaf portion. In the preferred embodiment, the invention is formed in polypropylene as a stamping from a single piece of material. The mounting leaf portion is formed in a winged U-shape with the orientation leaf formed as a substantially retangular section which is hingedly attached by a living hinge to the base of the U-shape and fits in the open portion of the U-shape, stamped out of the same leaf area to lie flat in the same plane with the morphable portion being the orientation leaf that allows the transformation of the device into a multi-postion mounting device In accordance with the invention what is provided is a first mounting leaf portion having two insertion slots, a first slot in an upper wing portion of the mounting leaf, and a second insertion slot in a lower wing portion of the mounting leaf. The base portion of the mounting leaf has an orientation leaf hingedly attached, by way of a living hinge, to it along a pivotal hinge axis that is substantially midway between opposing edges of the mounting leaf profile. The edge opposing the living hinge, the attachment edge, has a set of holes in its binding region, preferably removably punched to attach to a set of rings in a multi-ring binder, such as in an "organizer", without having to open and close the ring.

Specifically, what is provided for is a set of insertion slits that are symmetrically balanced in the mounting leaf portion, at the top and at the bottom, to allow for the insertion of the stiff backing card of a pad, such that the rigid backing card of the pad adds to the structural integrity of the combined device. A detent at the top of the mounting leaf portion is provided to permit the stapled end of the pad to slide down securely and lie colinear with the top edge of the mounting leaf portion so as not to protrude out from the top when placed into a binder. Further, the width of the mounting leaf portion is substantially a page width for a predetermined with of a page for a host book to which the platform is to be attached. The actual surface is slightly wider to allow the insertion slits to be provided without tearing out the surface. If needed, the extra edge portion central to the base portion of the mounting leaf may be cut out to allow close placement to rings when inserted into a book with rings and positioned lying flat. The orientation leaf portion is substantially one half that page width allowing for the living hinge to be appromimately mid way between opposing edges of the mounting leaf portion. This permits the mounting leaf to be positioned into coplanar locations that are substantially adjacent with respect to the pivotal reference point of the binding region of the orientation leaf portion.

Various ways can be employed to make the device, and the invention provides for the formation of the device in all of these ways and in all of the disclosed application specific combinations.

The formation of the orientation leaf in the same plane as the mounting leaf and from the same perimeter panel of material allows for the formation of a minimalist construction using the least material possible to form the morphing leaf allows for the formation of such a platform in which both the mounting leaf and the orientation leaf lie in exactly the same plane, yielding the flatest formation of such device possible.

The following reference to two versus four position refers to the number of positions that the mounting leaf portion can be placed in while retaining the same orientation of the upper most or top face of the mounting leaf.

In accordance with invention what is provided for is a two position mounting leaf attachable along the attachment edge of an orientation panel having a binding region with holes.

A four position mounting leaf attachable along an extention leaf to a binder at a spine of such a binder.

A binder morphing leaf combination where said morphing leaf is attached along an outer edge of a cover of said binder.

A pad holder morphing leaf combination where said morphing leaf is attached at a spine of a folio having a front cover attached to the same spine.

A morphing leaf having a mounting leaf portion with at least two diagonally opposing diagonal mounting slots.

A morphing leaf having a mounting leaf portion with a pen holder loop a part thereof.

A morphing leaf having a living hinge formed between said mounting leaf and said orientation leaf in polypropylene with a single knife cut. Said morphing leaf having a living hinge formed in polypropylene with a single knife cut and aperture cuts. Said morphing leaf having a living hinge formed in polypropylene with multiple knife cut. Said morphing leaf having a living hinge formed in polypropylene with a single knife cut. Said morphing leaf having a living hinge formed in polypropylene with a stamping pressing having a spread middle.

A morphing leaf where the binding region of the attachment edge is formed as a set of interleaving finger clasps.

A morphing leaf formed from metal where the living hinge between the mounting leaf and the orientation leaf is formed as a piano hinge.

A mounting leaf having sheared surfaces so as to offset the insertion slits from the base portion of the mounting leaf to permit easier insertion of a backing card from an accessory.

A morphing leaf platform having a mounting leaf and an orientation leaf formed from two separately attachable pieces of material.

A morphing leaf platform having said orientation leaf portion formed in a wire frame. A Morphing leaf platform having said orientation leaf portion formed as a snap in section of plastic.

A morphing leaf platform formed with only one wing section and an orientation leaf. Such a formation may be constructed using all of the above mentioned means of construction.

A morphing leaf platform having a mounting leaf with clip attachment devices attached thereto.

A morphing leaf having the attachment edge of the orientation leaf hingedly attached to a rolling hinge. The rolling hinge of such a morphing leaf where the hinge is comprised of a set of knife cut or laser cut living hinges. The rolling hinge of such a morphing leaf having an aperture therein. The rolling hinge of such a morphing leaf where the rolling hinge comprises two rolling strips.

A morphing leaf having a rolling hinge and an attachment strip for attaching to a host book by bonding or by adhesive or other similar or like permanent attachment means.

A morphing leaf platform having a pocket formed on its top surface for top insertion of an accessory card.

BRIEF DESCRIPTION OF THE DRAWINGS

FIG. 5 shows a morphing leaf with insertion slots at diagonally opposing corners.

FIG. 5A shows a knife cut living hinge with cuts from both sides.

FIG. 5B shows a knife cut living hinge with a single cut from one side.

FIG. 5C shows a living hinge stamped from both sides to have a spread middle section.

FIG. 8C1 shows a morphing leaf where the orientation portion is a pivotal U-shaped frame section.

FIG. 8D shows a morphing leaf constructed from molded plastic with mating snap pins for the hinge mechanism.

FIG. 8E shows the pin portion of the hinge

FIG. 8F shows the socket portion flipped to view and the location of the mating snap pin in relationship to it.

FIG. 12A shows the pocket edge for folding over attaching and forming the pocket FIG. 12B shows the pocket edge sealed to form the pocket.

DETAILED DESCRIPTION OF THE INVENTION

Figure 1:
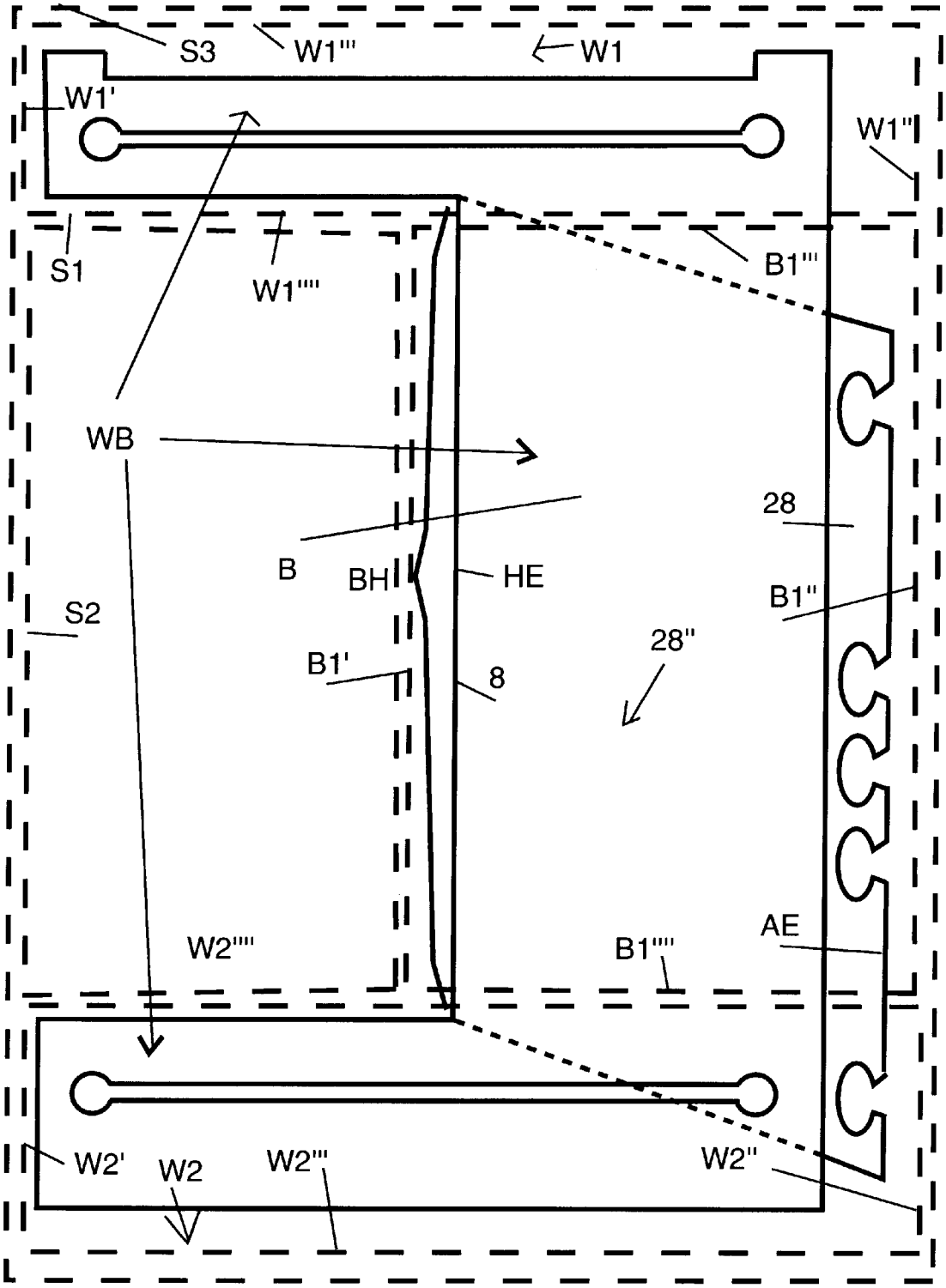
FIG. 1 is a perspective view of a two position morphing leaf which depicts the perimeters of the various segments of the morphing leaf and shows the morphing action of the orientation leaf.
Figure 1A:
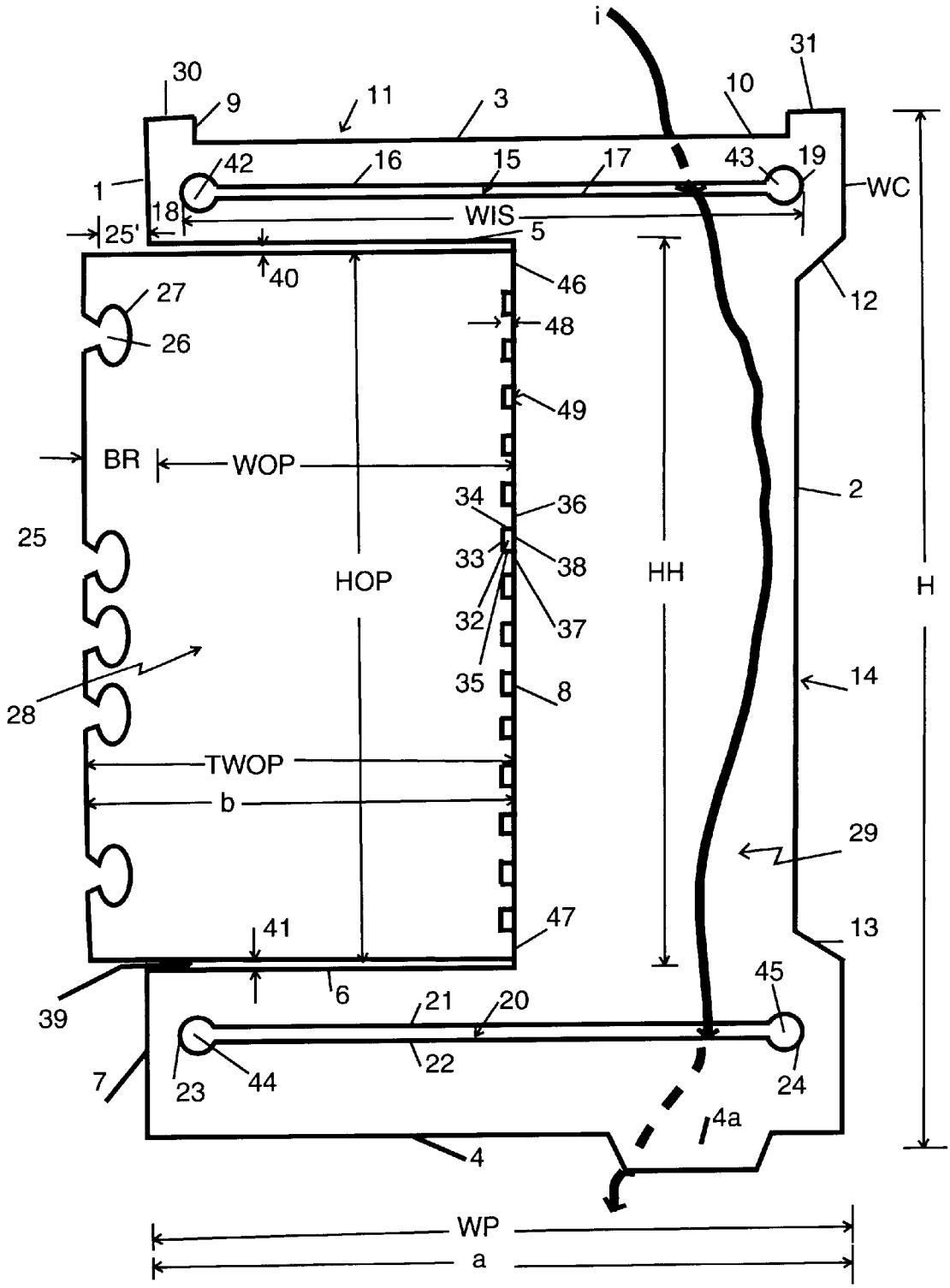
FIG. 1A shows the morphing leaf of FIG. 1 laid out flat in one plane.

In FIGS. 1 and 1*a* what is shown is a two position morphing leaf 28". it is comprised of a mounting leaf portion WB formed from wing sections W1 and W2 and base body section B. The general construction is shown as a stamping from one piece of flexible plastic material. Vinyl coated paper board, or durable paper board may also be used. The sections of the stamping are outlined with dotted perimeter lines to show the broad representation of the segments. S1 is the outside perimenter of the combined segments W1, W2, and B, otherwise called the mounting leaf portion. S2 is the outline perimeter of the multisided orientation leaf portion. S3 is the overall permiter outline of the entire morphable leaf. You can see that the overall perimeter is substantially retangular in Formation and that the mounting leaf portion takes the shape of a U-shaped portion with two wings and a base and that the orientation leaf portion takes on a substantially retangualar shape. The side edges of each of the portions are marked separately as W1',W1", W1'", W1"", W2',W2", W2'", W2"", B1',B1",B1'", and B1"". The orientation leaf portion, 28 has opposing edges HE, the living hinge edge where it is attached at hinge 8 to the mounting leaf portion, and AE the attachment edge where it has a hole pattern in its binding region for attaching to a multi ringed binder. The Binding hinge BH is of an extent which is substantially the height of the orientation leaf. The orientation leaf 28, is shown in a morphed position allowing the mounting leaf portion to be pivotally rotated from one side to the other. The leaf extent a is hingedly attached to the leaf extent b and both are formed integrally from a stamping of the same sheet of material such that they remain hingedly attached at hinge 8 and lie in exactly the same plane, when flat. The Insertion slots 15 and 20 allow for a card to be inserted following track "I". If a pad is inserted its top head sets into detent 11 formed by edges 10,3, and 9. The width of the slot WIS is substantially the width of the accessory, a predetermined width, such as a pad width, which in the US could be 8½ inches for a standard three ring binder or 5½ inches for a popular organizer size. The actual total width of the mounting leaf WP adds width portion WC to enable the slots which may be alternatively formed soley as cuts to have the end 18 and 19 be far enough away from the edge 14 so as not to tear through. The orientation leaf, 28, has a width substantially ½ the width of the distance between opposing edges 1 and 14 of the mounting leaf. The orientation leaf has an additonal extent 25 of predetermined width BR to attach to a host. When attached at the ring holes, the mounted accessory which inserts into the slots along trajectory "i" and covers the face of the device can be colocated to substantially adjacent locations to the right and to the left of the attachment location along attachment edge 25, while retaining the same orientation in both positions. The overall height of the mounting leaf, H, is substantially page height and allows the device to fit into a binder and not protrude out from top or bottom. This height might be 11 inches for example or could be smaller depending on the binder it is used in and the associated page size in the binder. The tab portion 4*a* would normally be formed to extent past the bottom edge of the paper but not extend outside of the bottom edge of the binder for example. The formation from a single sheet of polyprop provides for the flattest lowest cost formation of a windowing leaf attachment structure. The formation of the orientation leaf and mouting leaf in coterminous relationship one segment to the other eliminates the need for any other material to position the hinged fold at the middle point of the mounting leaf and ensures that the two components lie flat in exactly the same plane.

Furthermore, as seen in FIGS. 1 and 1*a*, In accordance with invention what is provided for is a two position morphing leaf(28"), comprising a mounting leaf portion (WB) and an orientation leaf portion(28), attachable along the attachment edge of said orientation leaf portion(28), having a binding region(BR) with holes(26,27) for forming an attachment edge, (AE), as a morphable multi-sided irregular pattern of material(S3), comprising a first mounting leaf portion(WB) and a second orientation leaf portion (28), said portions taken together forming a substantially rectangular leaf(shown as dotted section S3), said first mounting leaf portion(WB) comprising an irregular multi-sided portion having two wing portions(W1,W2) connected by a base portion(B) provided as the central body of multisided mounting leaf(28")(the three portions identified as WB, shown as dotted section S1), said second orientation leaf portion(28) formed within said substantial retangular leaf(shown as dotted section S2) to have a hinge edge(8), identified as the hinge edge of the mounting leaf portion, where it is attached to a side of the base portion(B) and to have an attachment edge(AE), for attaching to a host.

Figure 2:
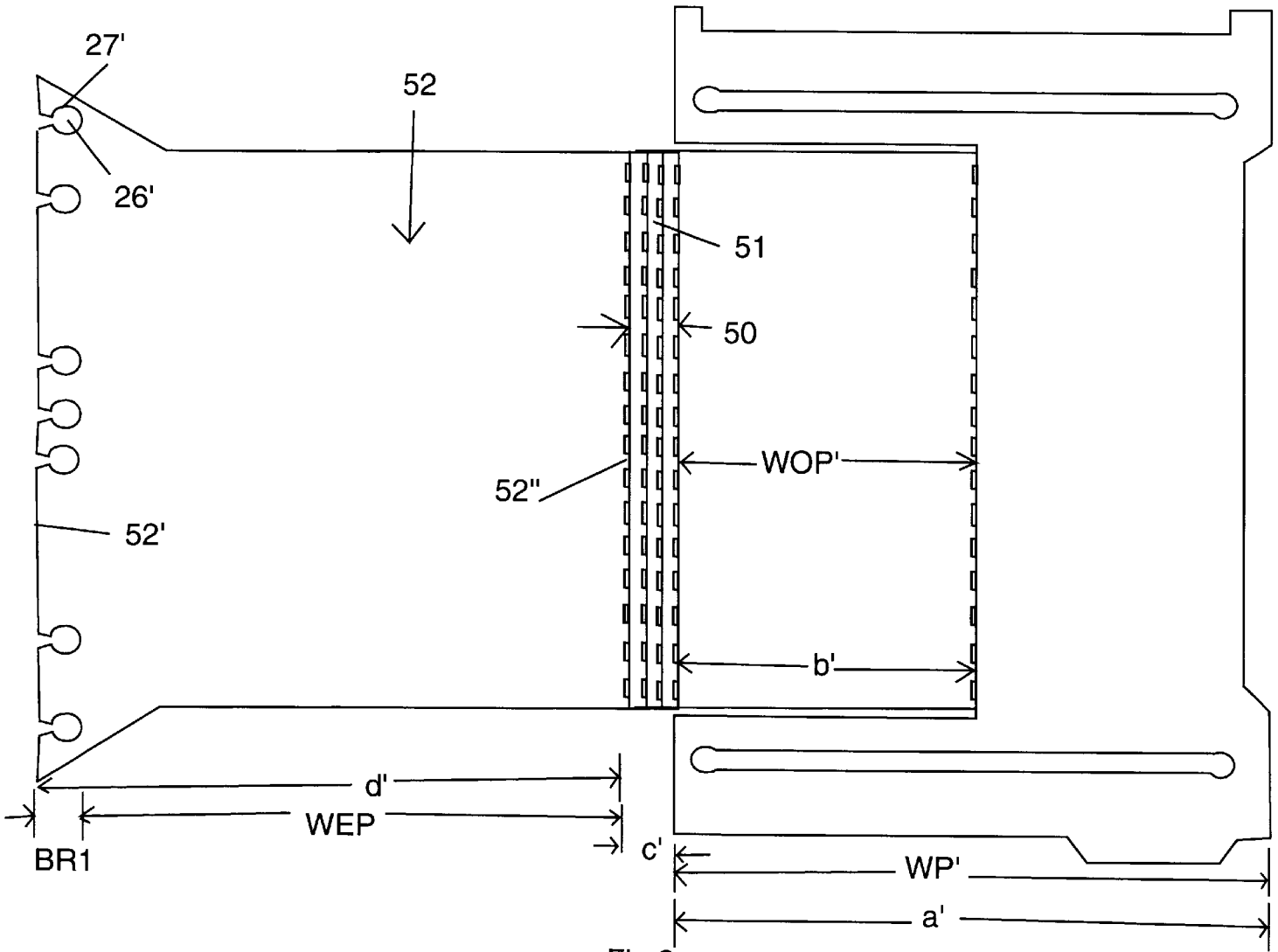
FIG. 2 shows a morphing leaf comprising a rolling interleaving hinge and an extension leaf.

A four position morphing leaf as shown by example in FIG. 2, comprising a mounting leaf,where said mounting leaf attachable along an extention leaf(58), comprising extent d' and c', where extent d' is comprised of extent WEP(predetermined width of extension panel, and BR1, binding region portion of extension leaf portion) to a binder at a spine of such a binder.

Figure 3:
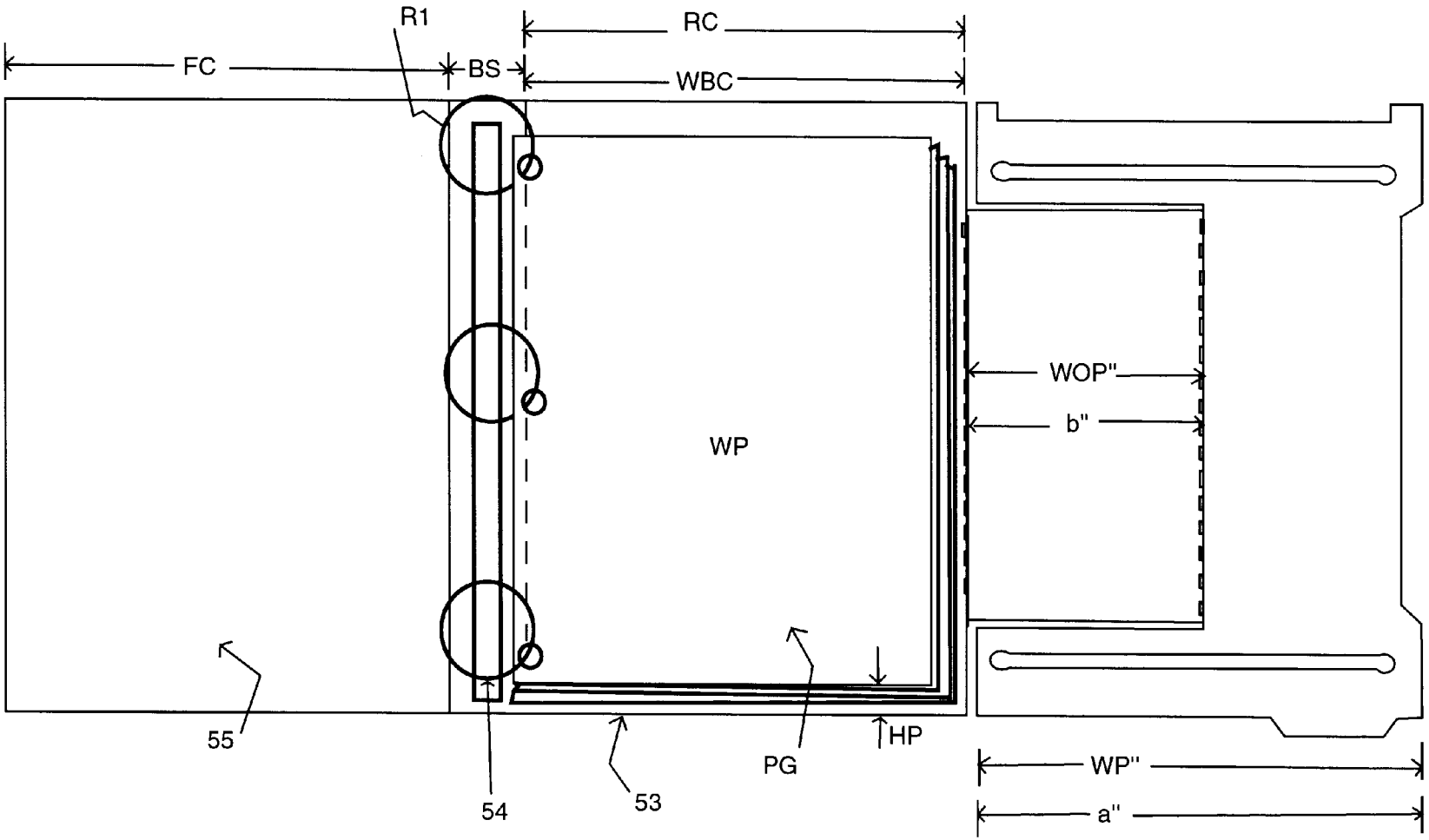
FIG. 3 shows a morphing leaf integrally formed on the rear cover of a binder.

A binder morphing leaf combination, as shown in FIG. 3, where said morphing leaf, comprising a mounting leaf with a predetermined width, WP", is attached along an outer edge of a cover of said binder, having a predetermined width WBC. The width of the orientation leaf portion is taken to have the same relationship to the width of the mounting leaf portion, WP" as in the two position morphing leaf detailed in FIG. 1,1*a*, above.

Figure 4:
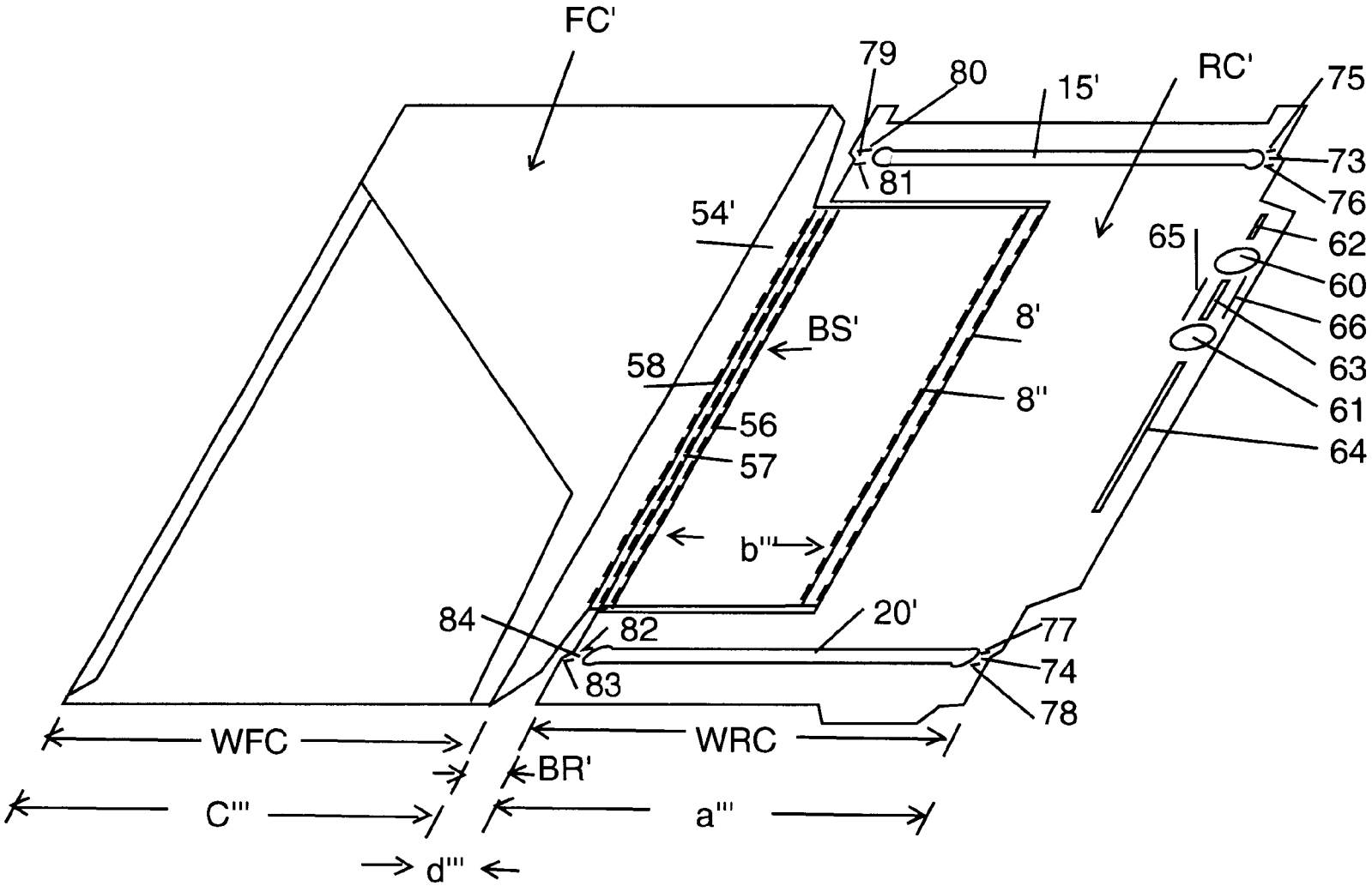
FIG. 4 shows a morphing leaf integrally formed as a pad holder

A pad holder morphing leaf combination,as shown in FIG. 4, where said morphing leaf portion is comprised of a rear cover RC', which as detailed above in FIGS. 1,1*a*, has an attachment edge formed as a living hinge with rolling edges 56,57,and 58, with edge 58 being the outer most edge and acting as the attachment edge acting in a similar manner as detailed in FIG. 1,1*a* above, but in this case is attached at a spine(54') the spine portion connecting the front cover to the rolling hinge, of a folio having a front cover(FC') attached to the same spine(54'). The device is shown having a cover(FC') with a predetermined width WFC, and a predetermined rear cover width WRC. It is known to one skilled in the art, that the width of a front and rear cover of a folio are substantially equal. The ratio of the width of the orientation leaf extent b'" to the predetermined width of the rear cover WRC which is the mounting surface width, is the same as in the case of the morphing leaf structure detailed above in FIG. 1,1*a*.

A morphing leaf as detailed in FIG. 1,1*a* above, having a mounting leaf portion with at least two diagonally opposing diagonal mounting slots(67,70) and/or(68,69) as opposed to the substantially parallel mounting leaf top slot 15, and mounting leaf bottom slot 20 as shown in FIG. 1,1*a*).

FIG. 4 shows A morphing leaf, having a mounting leaf portion with a pen holder loop, 60,61, a part thereof.

FIG. 1 shows A morphing leaf having a living hinge formed between said mounting leaf and said orientation leaf in polypropylene with a single knife cut,hinge 8. In FIG. 1*a*, said morphing leaf has a living hinge, 8, formed in polypropylene with a single knife cut and aperture cuts shown as example 32 with sides 34,35,33, and 38. In FIG. 4, said morphing leaf has a living hinge formed in polypropylene with multiple knife cut(s), 8' and 8". In FIG. 5, said morphing leaf has a living hinge, 8'", formed in polypropylene with a stamping pressing having a spread middle, depicted in FIG. 5*a*,5*b*, and 5*c* where various means for forming a spread middle are depicted.

Figure 7:
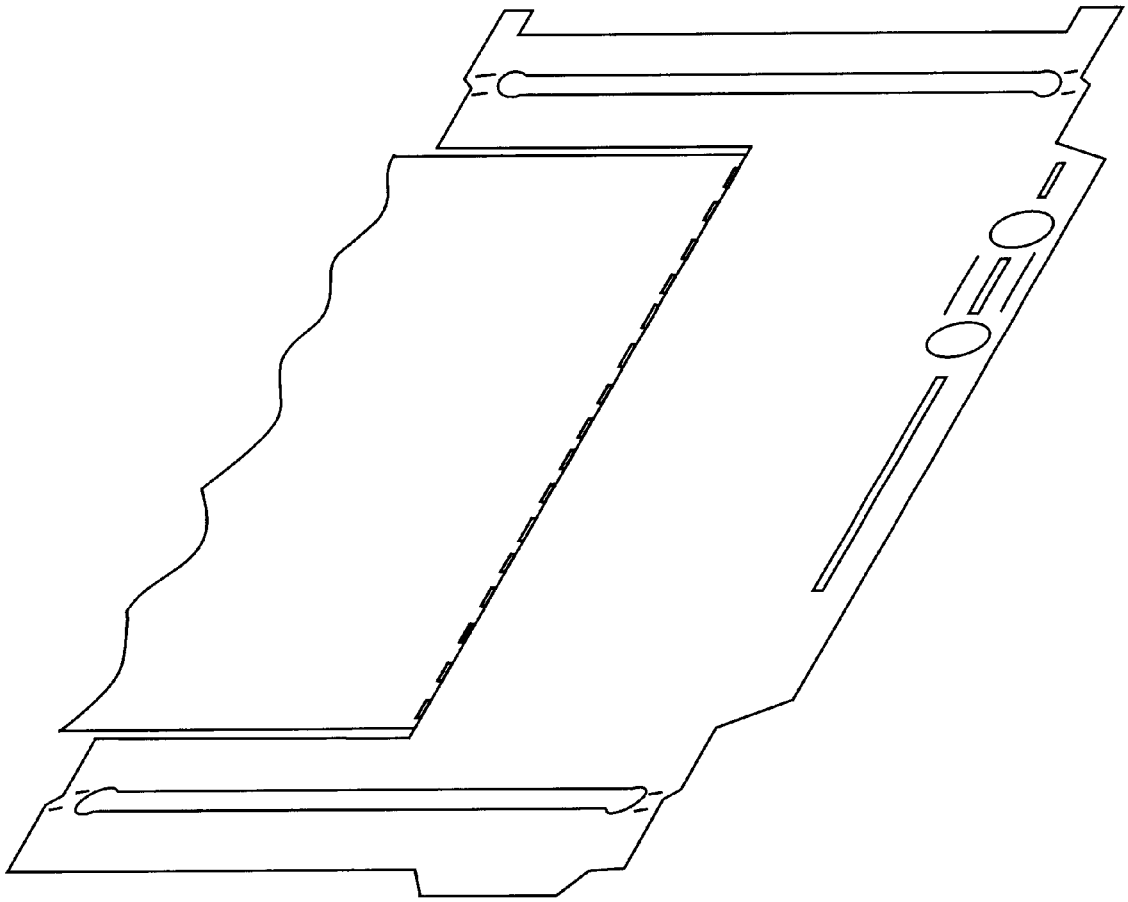
FIG. 7 shows a perspective view of the two position morphing leaf of FIG. 6.
Figure 7A:
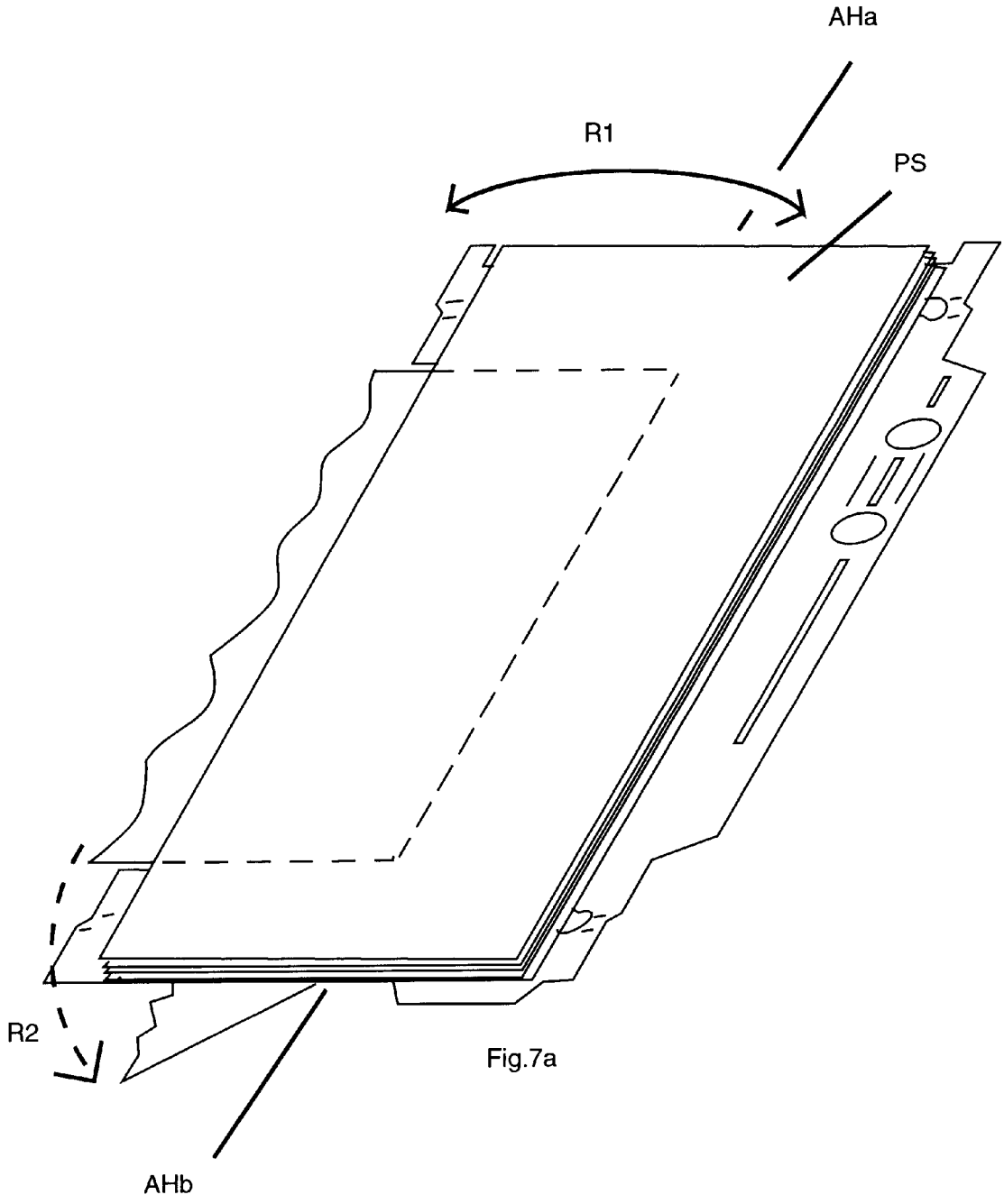
FIG. 7*a* shows a morphing leaf like the one of FIG. 7 with a pad inserted therein.
Figure 7B:
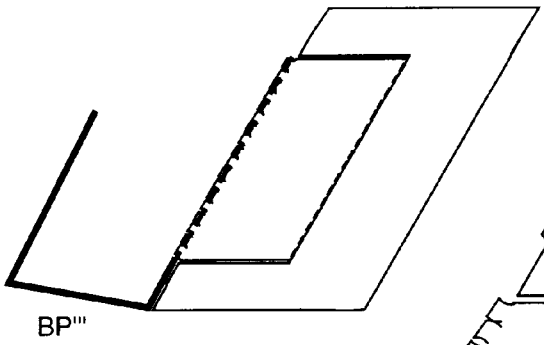
FIG. 7B shows a morphing leaf having an orientation leaf with a finger clasp attachment edge.
Figure 7B:
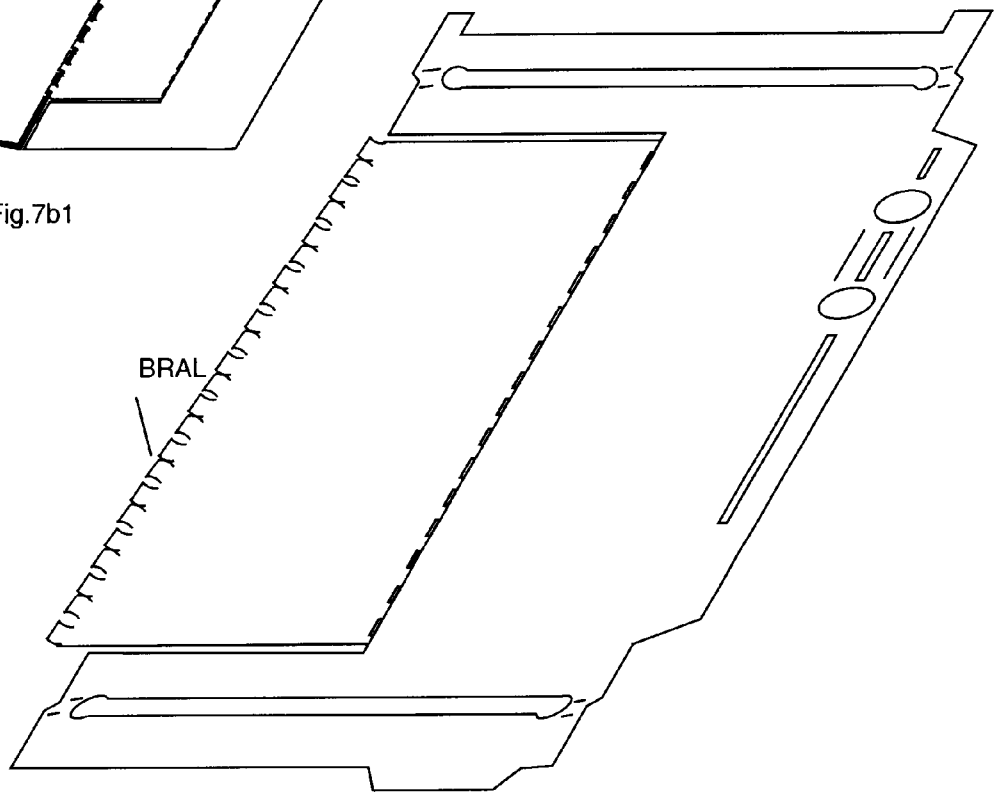

In FIG. 7*b*, A morphing leaf is shown where the binding region of the attachment edge, BRAL, is formed as a set of interleaving finger clasps. FIG. 7*b*1 shows a typical u-shaped extension wire frame for insertioninto the interleaving finger clasps for forming an extension section.

Figure 8:
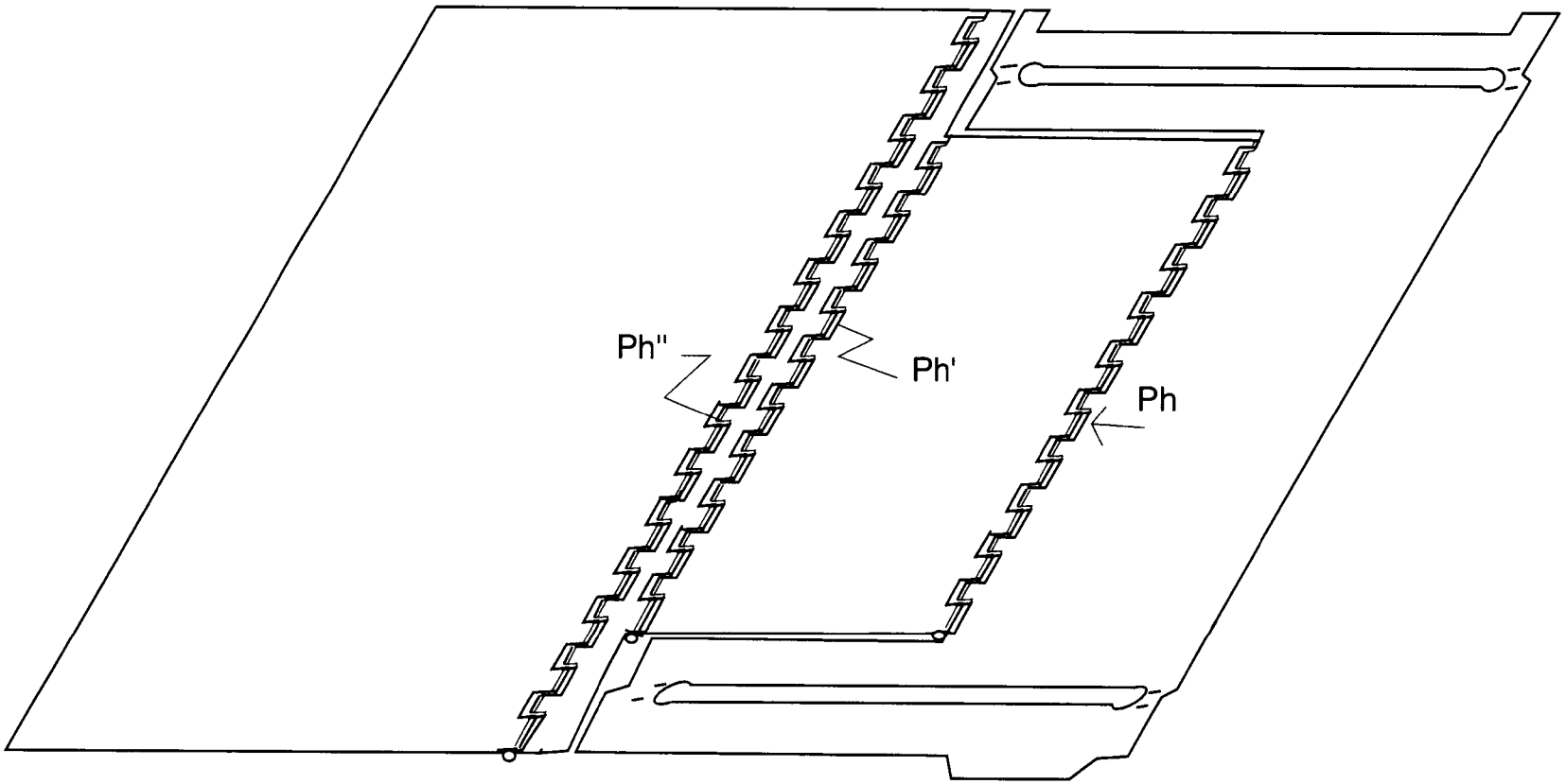
FIG. 8 shows a binder having a morphing leaf formed in metal with a piano hinge.

FIG. 8 shows a morphing leaf formed from metal where the hinge,ph, between the mounting leaf and the orientation leaf is formed as a piano hinge.

Figure 6:
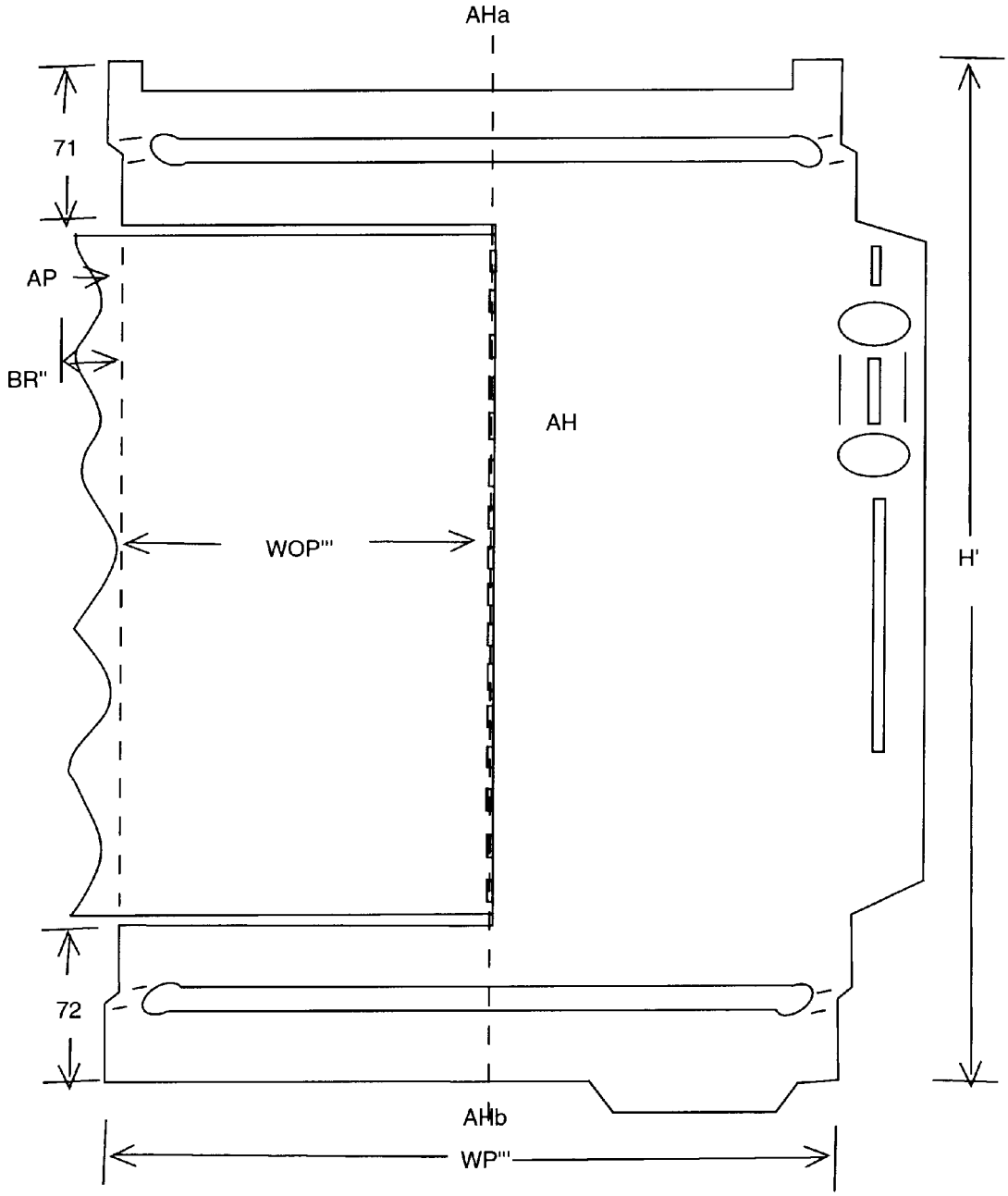
FIG. 6 shows a morphing leaf with a pen holder and providing for alternative orientation leaf attachments at the binding region of the orientation leaf.

In FIG. 6, A mounting leaf has sheared surfaces,set in sections 71 and 72, so as to offset the insertion slits, 15 and 20, from the base portion of the mounting leaf, B, to permit easier insertion of a backing card from an accessory.

Figure 8A:
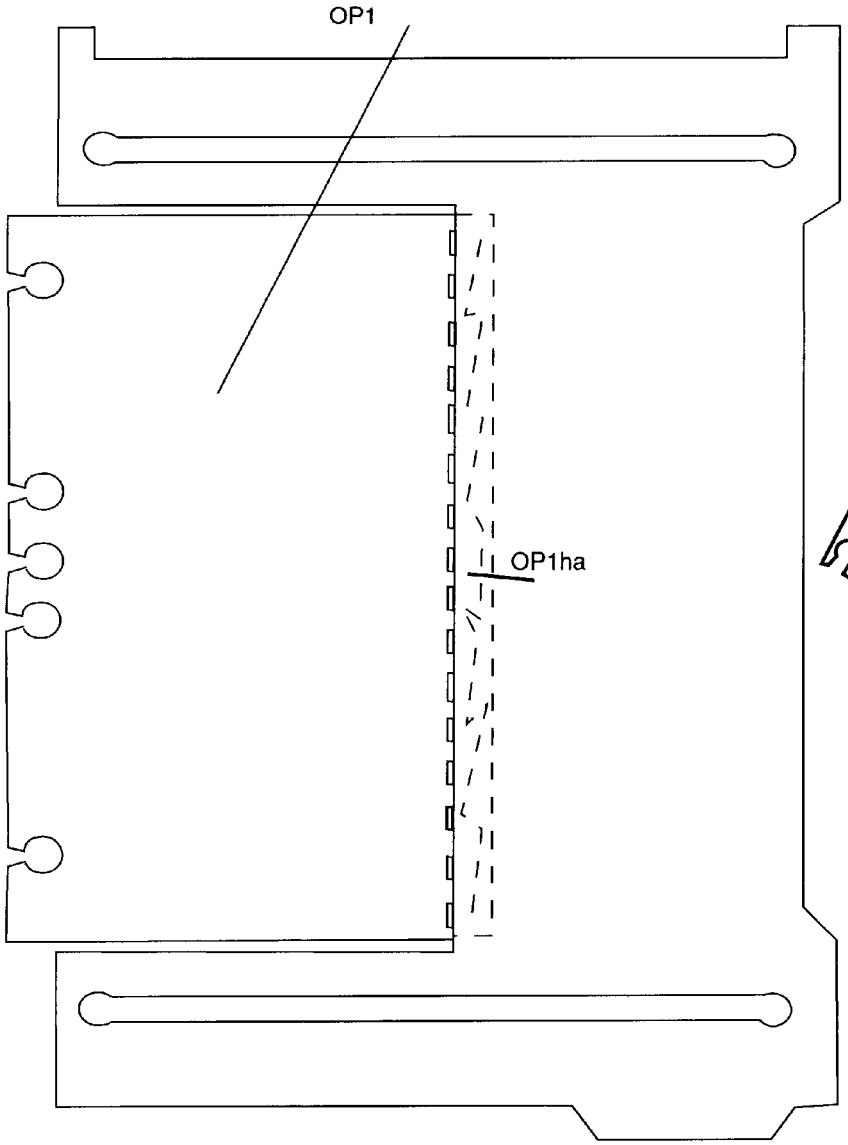
FIG. 8A shows a morhping leaf formed from two parts where the orientation leaf it adhesively attached to the mounting leaf.
Figure 8B:
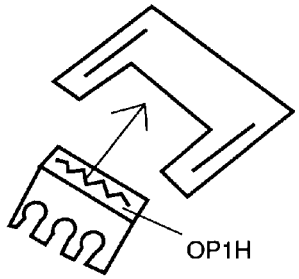
FIG. 8B shows the two portions of FIG. 8*a* separated.

FIG. 8*a* and 8*b* show a morphing leaf platform having a mounting leaf and an orientation leaf,OP1, formed from two separately attachable pieces of material.

Figure 8C:
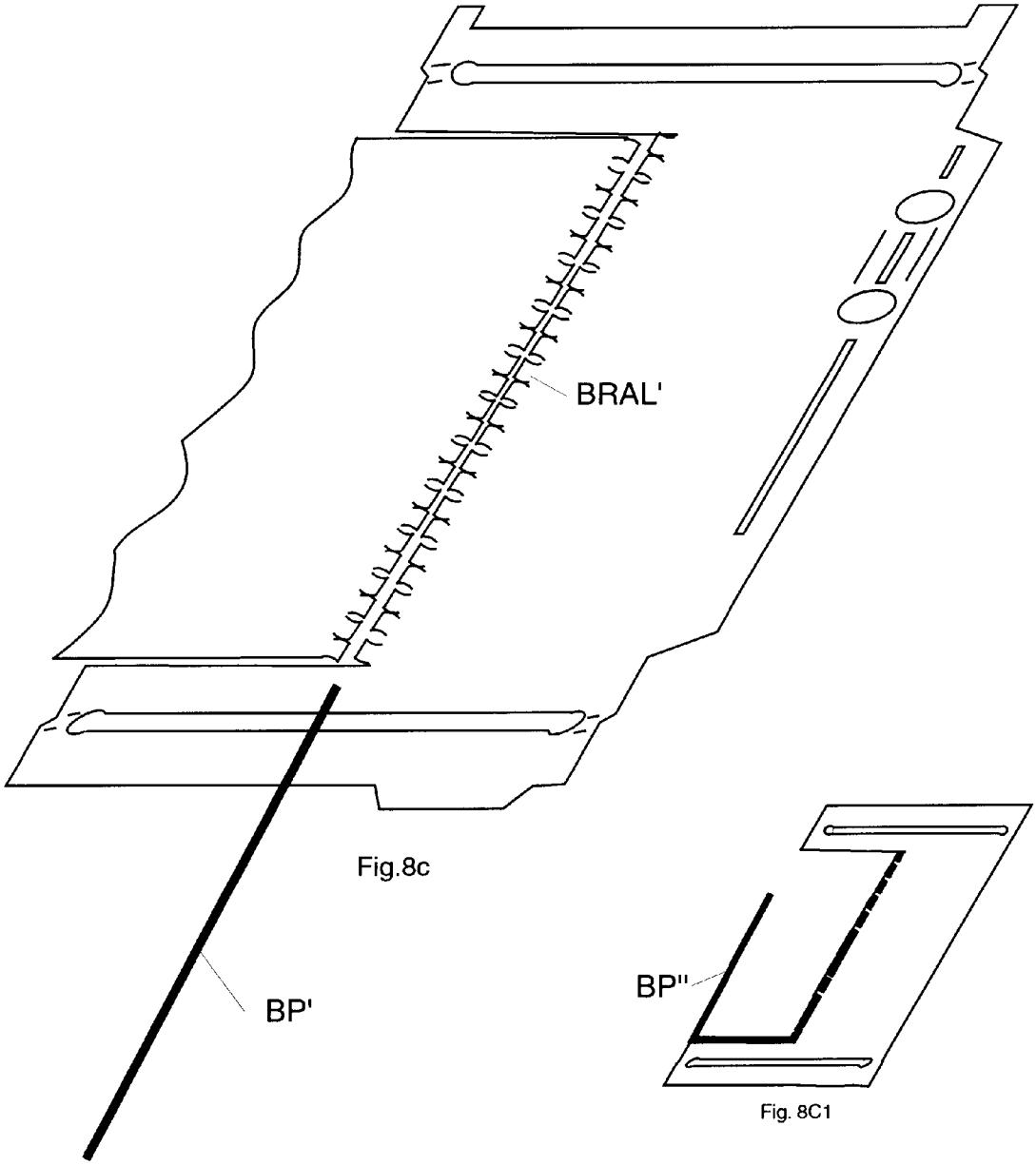
FIG. 8C shows a morphing leaf having a hinge attachment between said norphing leaf and said orientation leaf formed from interleaving finger clasps and a pivotal rod.

FIG. 8*c*1 shows a morphing leaf platform having said orientation leaf portion formed in a wire frame, BP", a pivotal hinge U-frame. FIG. 8C shows a morphing leaf platform having said orientation leaf portion formed as a snap in section of plasticwhere the plastic orientation panel has finger clasps BRAL' and is attached to mating finger clasps on the mounting panel by a wire BP'.

Figure 9:
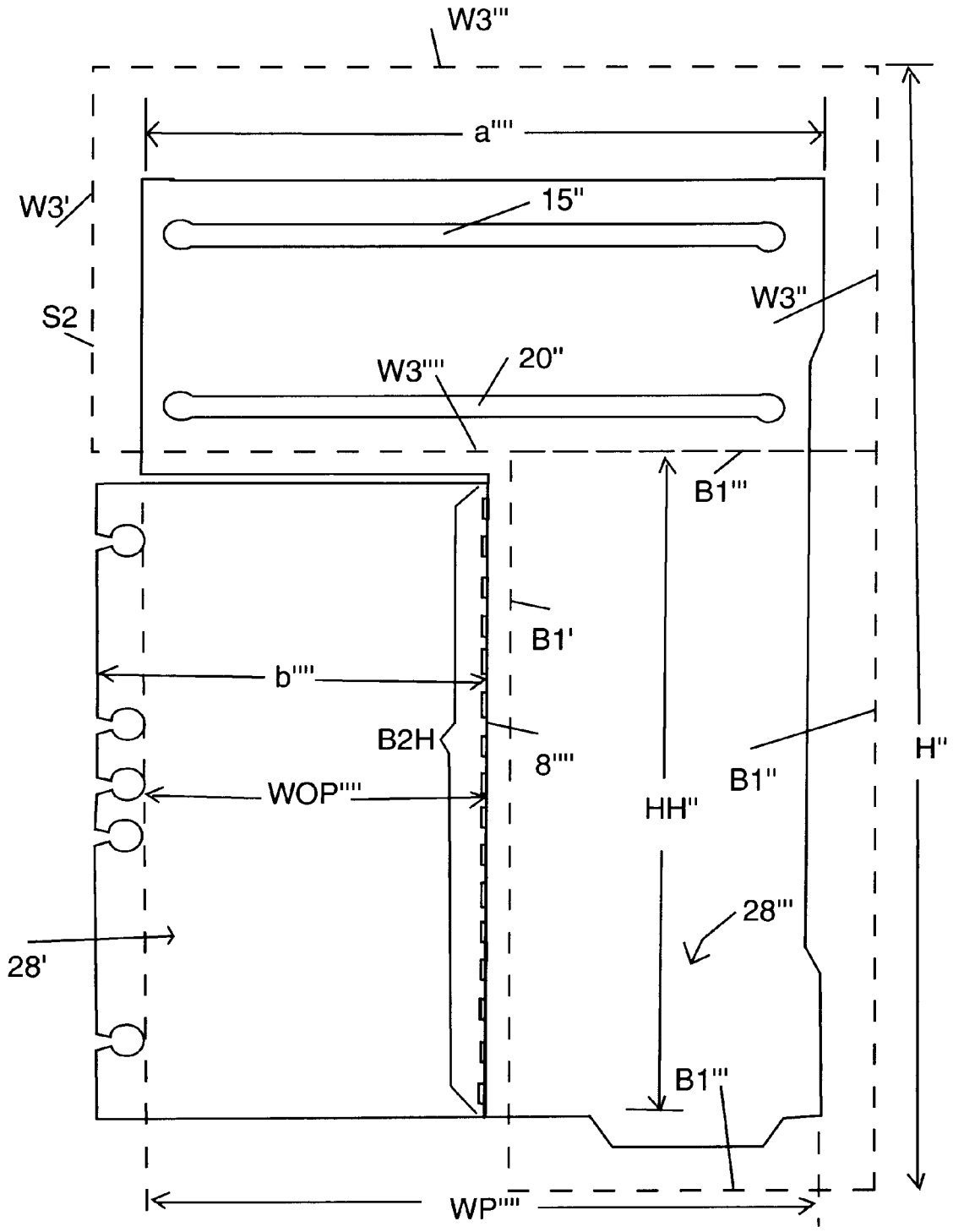
FIG. 9 shows an alternative embodiment of the morphing leaf having only one wing section.

FIG. 9 shows a morphing leaf platform formed with only one wing section comprising the section formed by W3', W3",W3'" and W3'" and an orientation leaf, 28'. Such a formation may be constructed using all of the above mentioned means of construction.

Figure 9A:
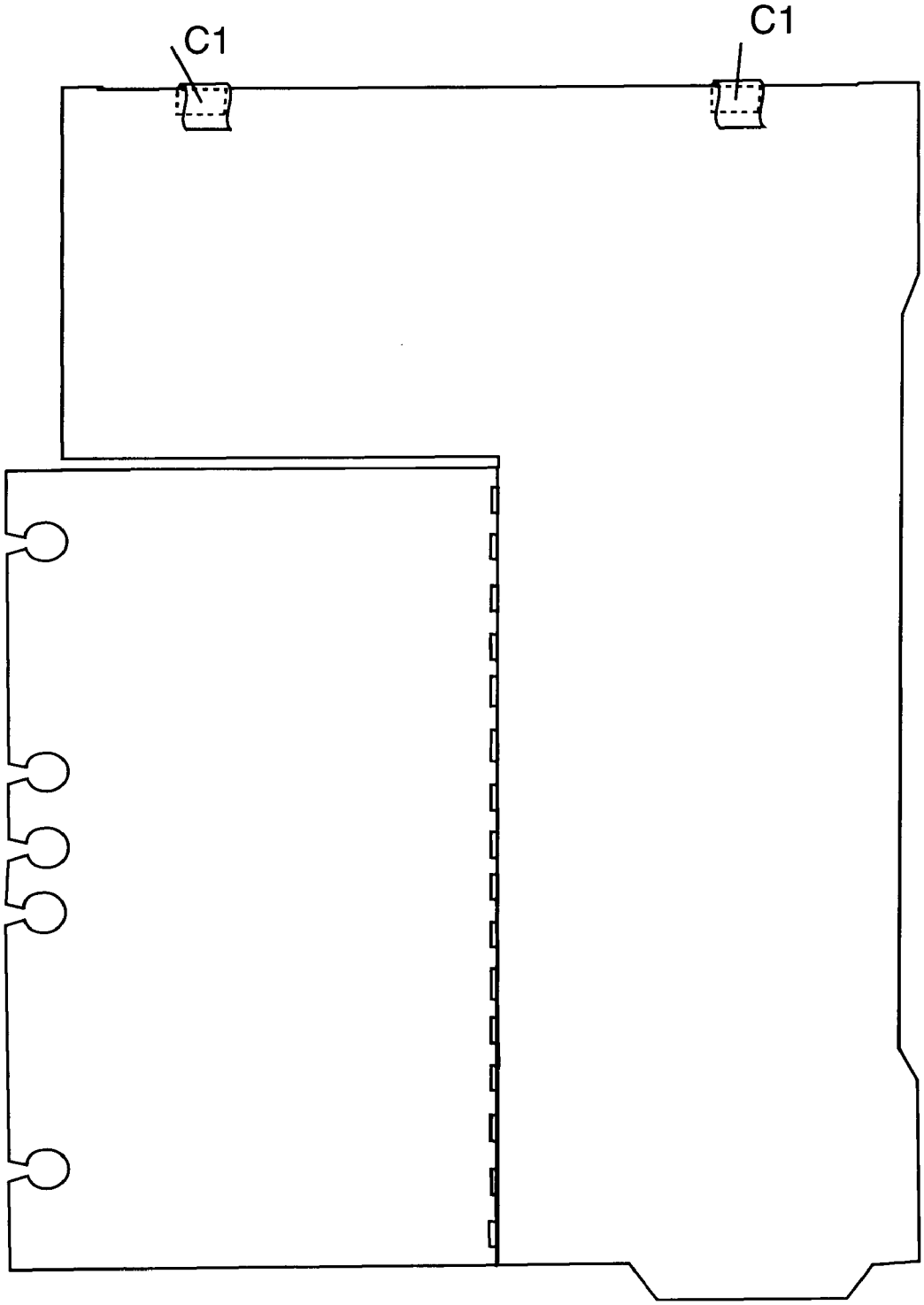
FIG. 9A shows a mounting leaf portion with springed clips.

In FIG. 9*a*, a morphing leaf platform has a mounting leaf with clip attachment devices,C1 and C2, attached thereto.

Figure 10:
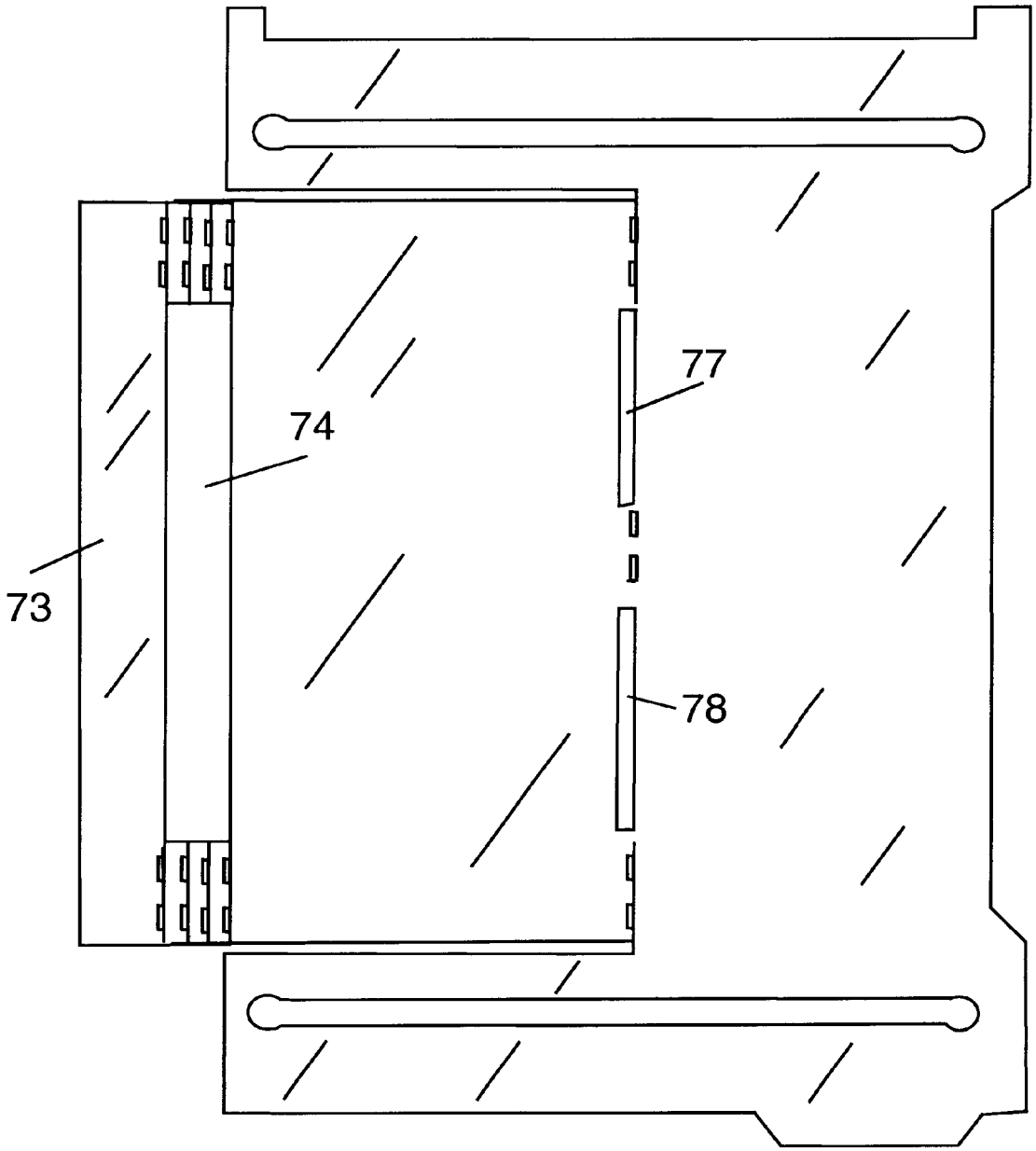
FIG. 10 shows an morphing leaf with a tab strip attachable orientation leaf.

In FIG. 4, a morphing leaf has the attachment edge of the orientation leaf hingedly attached to a rolling hinge, 56,57, 58. FIG. 10 depicts another variation of a rolling hinge where the rolling hinge of such a morphing leaf where the hinge is comprised of a set of knife cut or laser cut living hinges and the rolling hinge of such a morphing leaf having an aperture, 74, therein. The rolling hinge of such a morphing leaf, can be formed as in FIG. 11, where the rolling hinge comprises two rolling strips, 75.

In FIG. 10, a morphing leaf having a rolling hinge and an attachment strip, 73, for attaching to a host book by bonding or by adhesive or other similar or like permanent attachment means is depicted.

Figure 12:
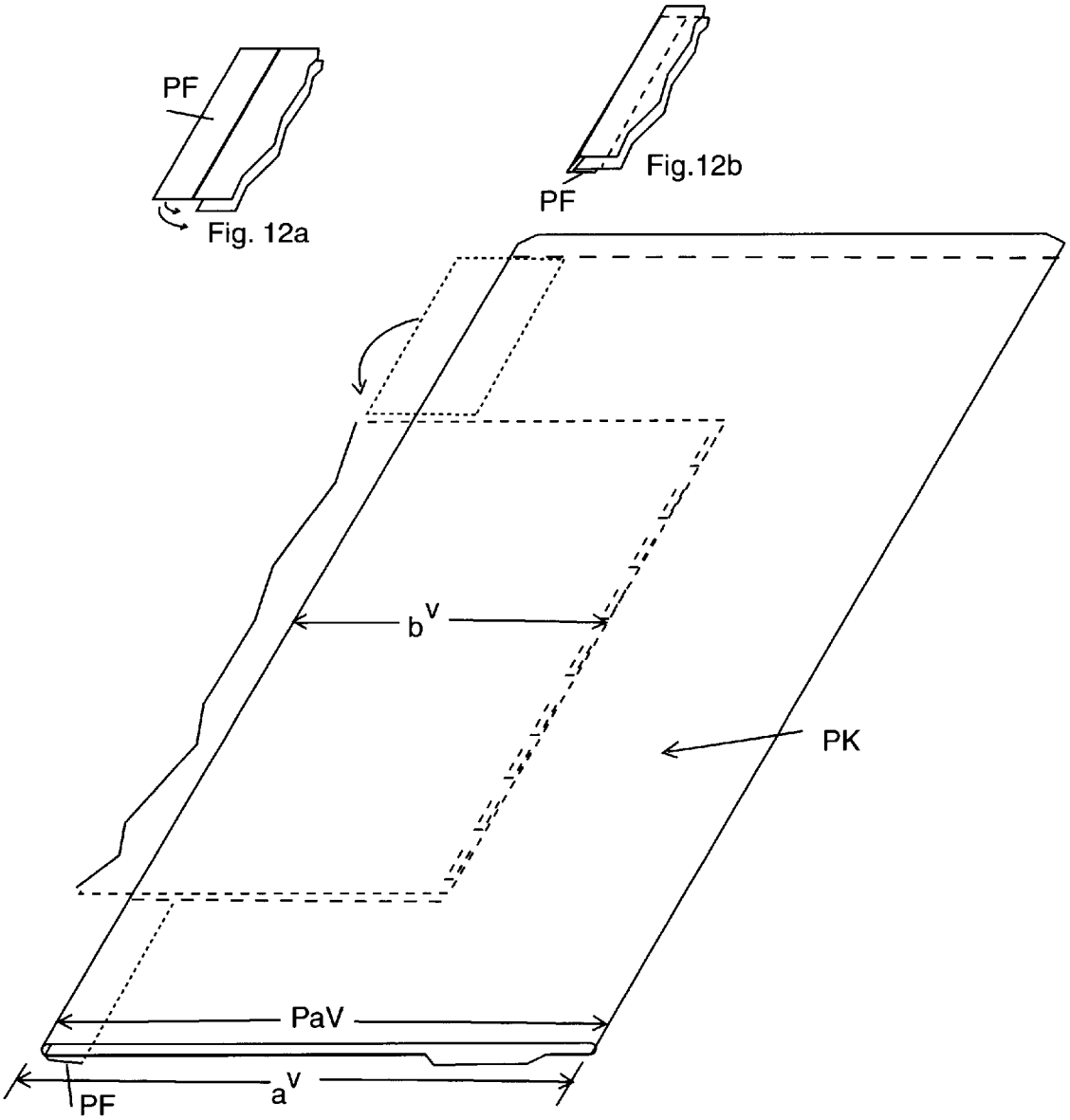
FIG. 12 show a morphing leaf with a pocket formed on the mounting leaf portion.

In FIG. 12, a morphing lea(l)f platform has a pocket,PK, formed on its top surface for top insertion of an accessory card. FIGS. 12A and 12*b* depict one means for forming the pocket using strip PF to attach to the bottom of the upper and lower wing portions of the mounting surface.

Figure/Element Numbers/Descriptions

| FIGURE | Element Numbers | Description |
|---|---|---|
| FIG. 1 | S1 | Outline perimeter of irregular multisided mounting leaf portion |
| | S2 | Outline Perimeter of multisided orientation leaf portion |
| | S3 | Outline Perimeter of multisided morphable leaf |
| | W1 | Top wing section of multi-sided mounting leaf portion |
| | W1' | Left side of top wing portion |
| | W1" | Right side of top wing section |
| | W1"' | Top side of top wing section |
| | W"" | Bottom side of top wing section |
| | W2 | Bottom wing section of multisided mounting leaf portion |
| | W2' | Left side of bottom wing section |
| | W2" | Right side of bottom wing section |
| | W2"' | Top side of bottom wing section |
| | W2"" | Bottom side of bottom wing section |
| | B | Central body of multisided mounting leaf |
| | B1' | Left side of central body |
| | B1" | Right side of central body |
| | B1"' | Top side of central body |
| | B1"" | Bottom side of central body |
| | 28 | Orientation leaf portion of multi-sided morphable leaf |
| | 28" | Morphing leaf |
| | HE | Hinge edge of orientation leaf |
| | AE | Attachment edge of orientation leaf |
| | WB | Mounting leaf portion comprising wing sections W1 and W2 and body portion B |
| | 8 | Hinge edge of mounting leaf portion |
| | BH | Height of hinge edge joining mounting leaf portion and orientation leaf portion |
| FIG. 1a | 1 | Top left side edge portion of mounting leaf |
| | 2 | Right side of mounting leaf |
| | 3 | Top side of mounting leaf |
| | 4 | Bottom side of mounting leaf |

-continued

| FIGURE | Element Numbers | Description |
|---|---|---|
| | 5 | Top mounting leaf orientation leaf portion cut out edge |
| | 6 | Bottom mounting leaf orientation leaf portion cut out edge |
| | 7 | Bottom left side edge portion of mounting leaf |
| | 8 | Orientation leaf/mounting leaf hinge portion hinge hinge |
| | 9 | Left top side accessory insertion portion |
| | 10 | Right top side accessory insertion portion |
| | 11 | Mounting leaf top side insertion cut out |
| | 12 | Right side mounting leaf ring recess top edge |
| | 13 | Right side mounting leaf ring recess bottom edge |
| | 14 | Mounting leaf right side ring recess cut out |
| | 15 | Mounting leaf top slot |
| | 16 | Mounting leaf top slot top edge |
| | 42 | Mounting leaf top slot left expansion region |
| | 17 | Mounting leaf top slot bottom edge |
| | 43 | Mounting leaf top slot right expansion region |
| | 18 | Mounting leaf top slot expansion portion left side |
| | 19 | Mounting leaf top slot expansion portion right side |
| | 20 | Mounting leaf bottom slot |
| | 44 | Mounting leaf bottom slot left expansion portion |
| | 45 | Mounting leaf bottom slot right expansion portion |
| | 21 | Mounting leaf bottom slot top edge |
| | 22 | Mounting leaf bottom slot bottom edge |
| | 23 | Mounting leaf bottom slot left side expansion portion |
| | 24 | Mounting leaf bottom slot right side expansion portion |
| | 25 | Orientation leaf attachment edge comprising a removable hole pattern |
| | 25' | Orientation leaf attachment edge attachment region |
| | 26 | Hole in attachment region for attaching directly to a binder |
| | 27 | Perimeter of hole 26 |
| | i | Insertion path of backing card of a pad or accessory |
| | H | Height of mounting leaf |
| | 28 | Orientation leaf portion |
| | 29 | U-shaped mounting leaf portion comprising rectangular upper wing section, rectangular base, and rectangular lower wing section |
| | 30 | Left top edge of pad insertion slot |
| | 31 | Right top edge of pad insertion slot |
| | 32 | Hinge cut out |
| | 33 | Left side hinge cut out |
| | 34 | Top edge hinge cut out |
| | 35 | Bottom edge hinge cut out |
| | 36 | "Land" area above and between hinge cut outs |
| | 37 | "Land" area below and between hinge cut outs |
| | 38 | Right edge hinge cut out |
| | 39 | Border separation between orientation leaf and mounting leaf |
| | 40 | Clearance at top border separation |
| | 41 | Clearance at bottom border separation |
| | 46 | Top most land area of living hinge |
| | 47 | Bottom most land area of living hinge. |
| | 48 | Living hinge cut out width |
| | 49 | Living hinge cut out |
| | BR | Binding region of attachment edge of orientation leaf portion |
| | WOP | width of orientation leaf portion |
| | HOP | Height of orientation leaf portion |
| | TWOP | Total width of orientation leaf comprising binding region and orientation leaf region |
| | b | Orientation leaf portion extent predetermined distance width |
| | a | mounting leaf portion extent predetermined distance width |
| | WP | Width of mounting leaf portion |
| | 29 | multisided morphable leaf comprising mounting |

-continued

| FIGURE | Element Numbers | Description |
|---|---|---|
| | | leaf portion and orientation leaf portion |
| | HH | Height of living hinge, 8 |
| | 4a | Tab extent |
| | WIS | Width of insertion detent for receiving a pad |
| | WC | Width of mounting leaf between right most edge of insertion top slot and right most edge of mounting leaf |
| FIG. 2 | 26 | Insertable hole in extension panel binding region |
| | 27' | Perimeter of insertable hole 26 |
| | 50 | Living hinge set comprising interleaving hinge portion |
| | 51 | Instance of a living hinge from interleaving hinge portion |
| | 52 | Extension leaf |
| | 52' | left attachment edge of extension leaf for attachment of extension leaf to a host |
| | 52" | Right edge of extension leaf |
| | WOP' | Predetermined width of orientation leaf portion |
| | WP' | Predetermined width of mounting leaf portion |
| | WEP | Predeterminedn width of extension leaf |
| | BR1 | Binding region portion of extension leaf |
| | a' | Mounting leaf portion |
| | b' | Orientation leaf portion |
| | c' | Interleaving hinge portion |
| | d' | Extension leaf portion |
| | EHR | Ext |
| FIG. 3 | 55 | Front cover binder |
| | 54 | Spine binder |
| | 53 | Rear cover binder |
| | PG | Page block on binder rings |
| | HP | Predetermined height of page block on binder rings |
| | WP | Predetermined width of a page from page block |
| | a" | Mounting leaf portion extent |
| | WP" | Predetermined width of mounting leaf portion |
| | b" | Orientation leaf portion extent |
| | WOP" | Width of orientation leaf portion extent |
| | FC | Front cover extent |
| | BS | Binding spine extent |
| | FC | Rear cover extent |
| | WBC | Predetermined width of rear cover |
| | R1 | Ring for attaching page block |
| FIG.4 | FC' | Front cover |
| | WFC | Predetermined width of front cover |
| | RC' | Rear cover |
| | WFC | Predetermined width of rear cover |
| | BS' | Binding spine |
| | BR' | Predetermined width of binding spine |
| | a"' | Mounting leaf extent |
| | b"' | Orientation leaf extent |
| | c"' | Front cover extent |
| | d"' | Binding spine extent |
| | 8' | first living hinge connecting orientation leaf and mounting leaf |
| | 8" | second living hinge connecting orientation leaf and mounting leaf |
| | 56 | Living hinge forming rolling hinge |
| | 57 | Living hinge forming rolling hinge |
| | 58 | Living hinge forming rolling hinge |
| | 54' | Spine portion connecting front cover to rolling hinge |
| | 60 | Writing instrument top insertion hole |
| | 61 | Writing instrument bottom insertion hole |
| | 62 | Flex crease cut |
| | 63 | Flex crease cut |
| | 64 | Flex crease cut |
| | 65 | Flex crease |
| | 66 | Flex crease |
| FIG. 5 | a'–a" | Section through living hinge 8"' |
| | 8"' | Living hinge |
| FIG. 5a | a'a" | Cross section view of LH of FIG. 5 |
| FIG. 5b | b'b" | Section through variation on LH |
| FIG. 5c | c'c" | Section through variation on LH |
| | 67 | Corner slot card mount |
| | 68 | Corner slot card mount/optional |
| | 69 | Corner slot card mount/optional |

-continued

Figure 11:
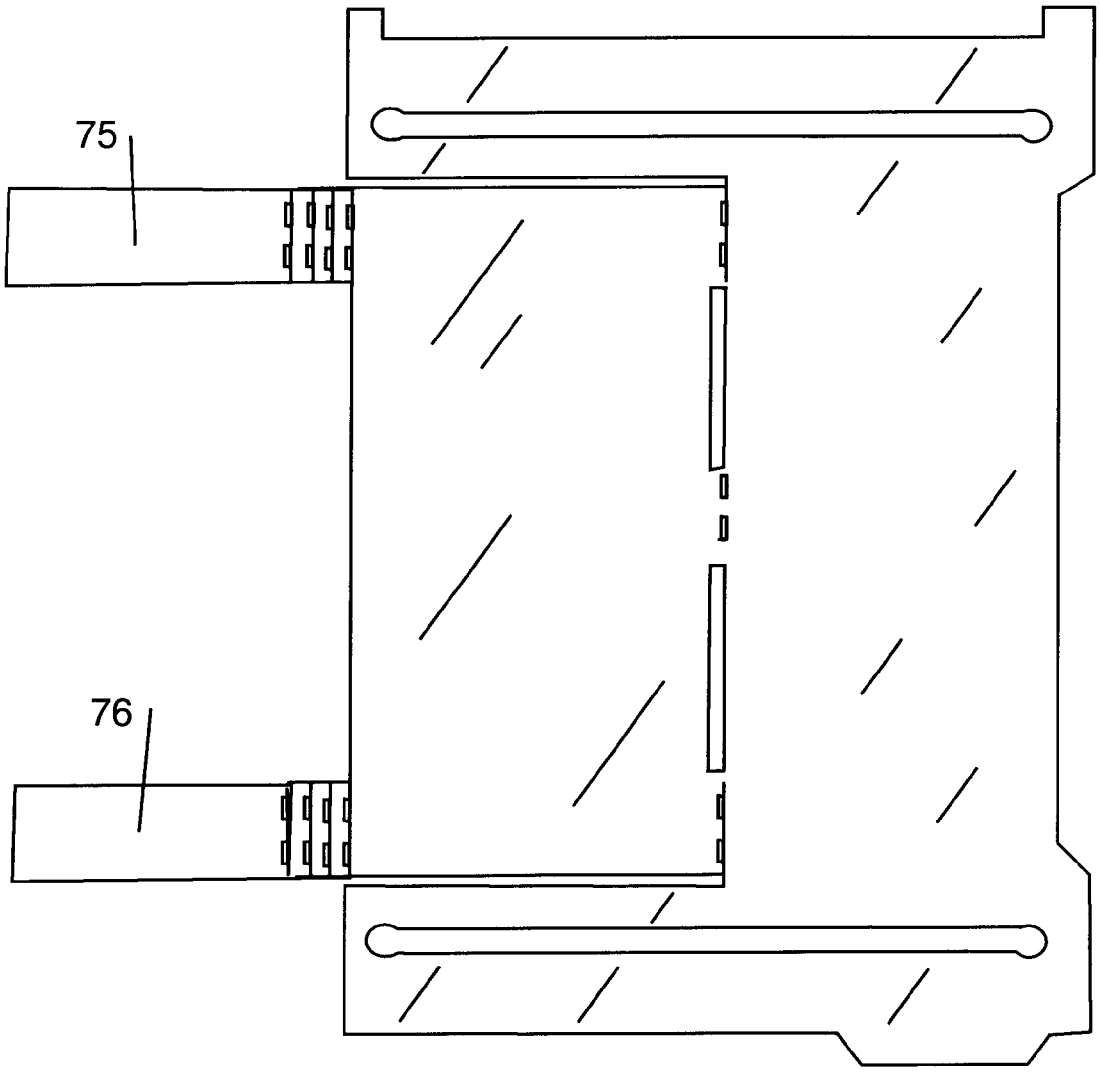
FIG. 11 shows a morphing leaf with two attachable rolling hinge strips.

| FIGURE | Element Numbers | Description |
|---|---|---|
| | 70 | Corner slot card mount |
| FIG. 6 | Aha–Ahb | Axis hinge pivotal axis |
| | AH | Living hinge pivot point |
| | H' | Height of mounting leaf |
| | WP"' | Predetermined width of mounting leaf |
| | WOP"' | Predetermined width of orientation leaf |
| | 71 | Height of upper wing section of mounting leaf |
| | AP | Attachment edge of orientation leaf in binding region |
| | BR" | Binding region of predetermined extent determined by nature of attachment structure |
| | 72 | height of corner wing section of mounting leaf |
| FIG. 7a | R1 | Pivotal motion of mounting leaf |
| | R2 | Pivotal motion of orientation leaf |
| | PS | Pad set inserted into mounting leaf |
| FIG. 7b | BRAL | Binding region attachment loops |
| | Ph | "Piano" hinge |
| | Ph' | "Piano" hinge |
| | Ph" | "Piano" hinge |
| FIG. 7B1 | BP"' | U-shaped extension wire frame |
| FIG. 8a | OP1 | Orientation leaf portion |
| | OP1ha | Orientation leaf portion hinge attachment location |
| FIG. 8b | OP1H | Orientation leaf portion hinge for attachment |
| FIG. 8c | BRAL' | Mating set of binding region attachment loops |
| | BP' | Binding Region Attachment loop locking pole |
| FIG. 8C1 | BP" | Pivotal hinge U-frame |
| FIG. 8d | T | Pivotal pin tip |
| | S | Pivotal mounting socket for pin tip |
| FIG. 8e | FT | Attachment edge for pivotal pin tip |
| | L | Raised portion of mounting leaf for receiving orientation leaf portion |
| FIG. 8f | dp | Diameter of Pin Socket Portion |
| | HT | Thinner predetermined width of orientation leaf |
| FIG. 9 | S2 | Perimeter outline of irregular multisided mounting leaf portion |
| | W3' | Left side irregular mounting leaf wing section |
| | W3" | Right side irregular mounting leaf wing section |
| | W3"' | Top side irregular mounting leaf wing section |
| | W3"" | Bottom side irregular mounting leaf wing section |
| | B1' | Left side base portion mounting leaf |
| | B1" | Right side base portion mounting leaf |
| | B"' | Top side base portion mounting leaf |
| | B"" | Bottom side base portion mounting leaf |
| | 8"" | Living hinge between orientation leaf and mounting leaf |
| | 28' | Orientation leaf portion of morphable multi-sided leaf |
| | 28'" | Mounting leaf portion to morphable multi-sided leaf |
| | a"" | Mounting leaf extent |
| | b"" | Orientation leaf extent |
| | WOP"" | Predetermined width of orientation leaf |
| | WP"" | Predetermined width of mounting leaf |
| | HH" | Predetermined height of orientation leaf/mounting leaf hinge portion |
| | H" | Predetermined height of mounting leaf portion |
| | B2H | Living hinge extent |
| | 15" | Accessory card insertion top slot |
| | 20" | Accessory card insertion bottom slot |
| FIG. 9a | C1 | Spring clip mounting component |
| FIG. 10 | 73 | Attachment flap |
| | 74 | Aperture in rolling hinge |
| | 77 | Aperture in living hinge |
| | 78 | Aperture in living hinge |
| FIG. 11 | 75 | Attachment strip |
| | 76 | Attachment strip |
| FIG. 12 | b" | Orientation leaf portion |
| | a" | Mounting leaf portion |
| | PF | Pocket flap |
| | Pav | Pocket predetermined width |

What is claimed is:

1. An attachment structure for pivotally attaching to a host object of which said attachment may become a part, for providing an auxiliary windowing structure as a morphing leaf for said host object, which windowing structure is for attaching an accessory structure there to, said attachment structure comprising:

a mounting leaf portion having a predetermined width, and an orientation leaf portion having a predetermined width, said mounting leaf portion comprising at least a top wing section, a central body section, and a bottom wing section;

said top wing section having perimeter features including a top wing left side, a top wing right side, a top wing top side, a top wing bottom side, a predetermined top wing width, said predetermined top wing width being substantially the predetermined width of said mounting leaf;

said central body section having perimeter features including a central body left side, said central body left side forming a mounting leaf hinge edge, a central body right side, a central body top side, a central body bottom side, a central body height, and a central body width, said bottom wing section having perimeter features including a bottom wing left side, a bottom wing right side, a bottom wing top side, a bottom wing bottom side, and a predetermined bottom wing width, said predetermined bottom wing width being substantially the predetermined width of said mounting surface, wherein a portion of said top wing bottom edge adjoins said central body top edge and said central body bottom edge adjoins a portion of said bottom wing top edge to form a mounting leaf portion comprising said top wing section, said central body section, and said bottom wing section, said mounting leaf portion so formed having a multi-sided irregular shape comprising a substantially "U" shaped perimeter outline with said top wing right side, said central body right side, and said bottom wing right side forming a common mounting surface right side, and providing for an outline perimeter interior to said attachment structure for colocating a multi-sided orientation leaf portion, said each of said top wing section and said bottom wing section having at least one mounting leaf slot for receiving an accessory structure, said orientation leaf portion having perimeter features including an orientation leaf left side, said orientation leaf left side being the orientation leaf attachment edge, an orientation leaf right side, said orientation leaf right side being the orientation leaf hinge edge, an orientation leaf top side, an orientation leaf bottom side, a predetermined orientation leaf width, and an orientation leaf height;

and wherein said orientation leaf hinge edge is pivotally and hingedly connected to said mounting leaf hinge edge of said central body left side along a pivotal axis, said orientation leaf/mounting leaf hinge, and where said orientation leaf and said mounting leaf are so formed as to lie substantially in the same plane;

such that when the orientation leaf left edge, is pivotally attached to a host object, said mounting leaf portion can be laid flat in a first position substantially coplanar with and nonoverlapping with said orientation leaf portion, and can be pivotally moved about said orientation leaf/mounting leaf hinge into a second position, substantially adjacent said first position where said central body portion of said mounting leaf is substantially on top of and overlapping said orientation leaf portion, to provide a pivotal two position windowing attachment structure.

2. The attachment structure of claim 1, where said orientation leaf predetermined width is substantially half said predetermined width of said mounting leaf and where said central body width is substantially said predetermined width of said orientation leaf.

3. An attachment structure for pivotally attaching to a host object of which said attachment may become a part, for providing an auxiliary windowing structure as a morphing leaf for said host object, which windowing structure is for attaching an accessory structure there to, said attachment structure comprising:

a mounting leaf portion having a predetermined width, and an orientation leaf portion having a predetermined width, said mounting leaf portion comprising at least a top wing section, and a central body section;

said top wing section having perimeter features including a top wing left side, a top wing right side, a top wing top side, a top wing bottom side, a predetermined top wing width, said predetermined top wing width being substantially the predetermined width of said mounting leaf;

said central body section having perimeter features including a central body left side, said central body left side forming a mounting leaf hinge edge, a central body right side, a central body top side, a central body bottom side, a central body height, and a central body width;

wherein a portion of said top wing bottom edge adjoins said central body top edge to form a mounting leaf portion comprising said top wing section, and said central body section, said mounting leaf portion so formed having a multi-sided irregular shape comprising a substantially "L" shaped perimeter outline with said top wing right side, and said central body right side forming a common mounting surface right side, and providing for an outline perimeter interior to said attachment structure for colocating a multi-sided orientation leaf portion, said top wing section comprising at least one mounting leaf slot for receiving an accessory structure, said orientation leaf portion having perimeter features including an orientation leaf left side, said orientation leaf left side being the orientation leaf attachment edge, an orientation leaf right side, said orientation leaf right side being the orientation leaf hinge edge, an orientation leaf top side, an orientation leaf bottom side, a predetermined orientation leaf width, and an orientation leaf height;

and wherein said orientation leaf hinge edge is pivotally and hingedly connected to said mounting leaf hinge edge of said central body left side along a pivotal axis, said orientation leaf/mounting leaf hinge, and where said orientation leaf and said mounting leaf are so formed as to lie substantially in the same plane;

such that when the orientation leaf left edge is pivotally attached to a host object, said mounting leaf portion can be laid flat in a first position substantially coplanar with and nonoverlapping with said orientation leaf portion, and can be pivotally moved about said orientation leaf/mounting leaf hinge into a second position, substantially adjacent said first position where said central body portion of said mounting leaf is substantially on top of and overlapping said orientation leaf portion, to provide a pivotal two position windowing attachment structure.

4. The attachment structure of claim 3, where said orientation leaf predetermined width is substantially half said predetermined width of said mounting leaf and where said central body width is substantially said predetermined width of said orientation leaf.

* * * * *